US011969061B2

(12) United States Patent
Annaka et al.

(10) Patent No.: US 11,969,061 B2
(45) Date of Patent: Apr. 30, 2024

(54) SLIDE FASTENER CHAIN AND SLIDE FASTENER

(71) Applicant: YKK CORPORATION, Tokyo (JP)

(72) Inventors: Shigeki Annaka, Runcorn (GB); Shigeyoshi Takazawa, Runcorn (GB); Steven Thomas, Runcorn (GB); Matthew Rawstron, Runcorn (GB)

(73) Assignee: YKK CORPORATION (JP)

( * ) Notice: Subject to any disclaimer, the term of this patent is extended or adjusted under 35 U.S.C. 154(b) by 0 days.

(21) Appl. No.: 18/023,238

(22) PCT Filed: Aug. 25, 2021

(86) PCT No.: PCT/GB2021/052205
§ 371 (c)(1),
(2) Date: Feb. 24, 2023

(87) PCT Pub. No.: WO2022/043684
PCT Pub. Date: Mar. 3, 2022

(65) Prior Publication Data

US 2023/0309663 A1 Oct. 5, 2023

(30) Foreign Application Priority Data

Aug. 27, 2020 (GB) ..... 2013417

(51) Int. Cl.
*A44B 19/32* (2006.01)

(52) U.S. Cl.
CPC ..... *A44B 19/32* (2013.01)

(58) Field of Classification Search
CPC ..... A44B 19/32
See application file for complete search history.

(56) References Cited

U.S. PATENT DOCUMENTS 9,474,341 B2 * 10/2016 Chou ..... A44B 19/32
9,661,902 B2 * 5/2017 Mikuma ..... A44B 19/32
(Continued)

FOREIGN PATENT DOCUMENTS

CN 108158140 6/2018
CN 108402607 8/2018
(Continued)

OTHER PUBLICATIONS

Annaka, Shigeki; International Preliminary Report on Patentability for PCT/GB2021/05220, filed Aug. 25, 2021, dated Feb. 28, 2023, 15 pgs.
(Continued)

*Primary Examiner* — Jason W San
(74) *Attorney, Agent, or Firm* — Taylor English Duma LLP

(57) ABSTRACT

A slide fastener chain includes first and second rows of coupling elements mounted on first and second longitudinal edges of the first and second fastener tapes. When the first and second rows of coupling elements are interdigitated, the first and second longitudinal edges remain spaced apart, and a first coupling element of the first row is received between two adjacent coupling elements of the second row such that: the groove of the first coupling element receives, in a first contact region, a portion of the second longitudinal edge, one of the grooves of the adjacent coupling elements receives, in a fourth contact region, a first portion of the first longitudinal edge, and another of the grooves of the adjacent coupling elements receives, in a fifth contact region, a second portion of the first longitudinal edge.

23 Claims, 15 Drawing Sheets

(56) References Cited

U.S. PATENT DOCUMENTS

| | | | | |
|---|---|---|---|---|
| 9,854,880 | B2 * | 1/2018 | Kojima | A44B 19/02 |
| 2007/0251063 | A1 * | 11/2007 | Kusayama | A44B 19/32 24/381 |
| 2015/0157096 | A1 * | 6/2015 | Mikuma | A44B 19/32 24/389 |
| 2021/0007447 | A1 * | 1/2021 | Kayahara | A44B 19/36 |
| 2022/0079302 | A1 * | 3/2022 | Kim | A44B 19/02 |
| 2023/0309663 | A1 * | 10/2023 | Annaka | A44B 19/32 24/389 |
| 2023/0397700 | A1 * | 12/2023 | Sakagami | D06M 10/025 |
| 2023/0397701 | A1 * | 12/2023 | Mizushima | A44B 19/60 |

FOREIGN PATENT DOCUMENTS

| | | |
|---|---|---|
| CN | 110946375 | 4/2020 |
| EP | 1388302 | 2/2004 |
| EP | 3165120 | 5/2017 |
| EP | 3626099 | 3/2020 |

OTHER PUBLICATIONS

Annaka, Shigeki; International Search Report and Written Opinion for PCT/GB2021/05220, filed Aug. 25, 2021, dated Dec. 6, 2021, 11 pgs.

YKK Corporation; Office Action for Taiwanese patent application No. 110126684, dated Nov. 2, 2022, 19 pgs.

* cited by examiner

SLIDE FASTENER CHAIN AND SLIDE FASTENER

TECHNICAL FIELD

The present disclosure relates to slide fastener chains and slide fasteners which are sealable. The disclosure also relates to an article including such a slide fastener.

BACKGROUND ART

Conventional slide fasteners (or zips or zippers) comprise a pair of stringers and an opening and closing means commonly referred to as a slider. Each stringer comprises a tape and a plurality of coupling elements. The coupling elements extend along a first edge of each tape and when the slider of the slide fastener has been moved to a closed position, corresponding coupling elements of the stringers interdigitate, couple or interlock. When each tape of the slide fastener is attached to separate portions of an article, the separate portions of the article may be releasably joined by closing the slide fastener by moving the slider to the closed position, and thereby bringing the coupling elements into said interdigitating relationship.

Slide fasteners are therefore both useful and versatile and are employed in a range of applications including garments, furnishings and luggage.

Known slide fasteners are generally constructed as follows. A coupling portion, usually in the form of a plurality of coupling elements (also referred to as teeth) is attached to a first edge of a tape to form a stringer. This first edge may be referred to as the coupling edge of the stringer. The tape can be woven or knitted and may be formed from, for example, polyester. The coupling elements may be attached to the tape by, for example, crimping or molding the coupling elements onto a reinforced edge of the tape. In some cases, the reinforced edge may comprise a cord of greater thickness as compared to the remainder of the tape. The cord may be sewn or woven into the tape.

Alternatively, the coupling elements may be formed as a continuous coil. In this case, the coupling elements are most commonly stitched to a surface of the tape at the edge of the tape or, alternatively, are woven or knitted into the tape.

Two stringers are brought together, such that the coupling elements of each stringer can attach to one another, for example, by interdigitating, to form a chain. The chain is generally planar, and the chain (and the coupling elements which form part of the chain) extends along a longitudinal axis of the chain (also referred to as the fastener axis). A slider is mounted to the chain, onto coupling elements of each respective stringer, such that it can move along the chain between the two stringers.

The slider commonly includes a main body having an upper and lower blade through which the coupling elements of each stringer pass. A pull tab or pull cord is attached to the main body which may be grasped by a user in order to effectively move the slider along the chain. The main body includes a guide post (sometimes referred to as a diamond) which, in part, defines a Y-shaped channel which is configured to carry coupling elements of the first and second stringers. The slider can comprise upper flanges and lower flanges which are disposed on each of the right and left side edge parts of the upper and lower blades, that is, the edges of the slider substantially parallel to a direction of operation of the slider. The flanges which are provided on the upper blade protrude downwards towards the lower blade and flanges which are provided on the lower blade protrude upwards towards the upper blade. The flanges are configured for sliding engagement with the coupling elements.

Movement of the slider along the chain in a first sliding direction along an axis of operation of the slider causes the coupling elements of the first stringer to attach to the coupling elements of the second stringer. When the slider is no longer able to couple elements any further in the first sliding direction i.e. substantially all the coupling elements of the first stringer are attached to substantially all the coupling elements of the second stringer, the slide fastener may be said to be in a fully closed configuration. Movement of the slider along the chain in a second sliding direction, along the axis of operation of the slider, opposite to the first sliding direction, causes the coupling elements of the first stringer to detach from the coupling elements of the second stringer. When the slider is no longer able to uncouple elements any further in the second sliding direction i.e. substantially all the coupling elements of the first stringer are detached from the coupling elements of the second stringer, the slide fastener may be said to be in a fully open configuration.

The chain is cut to a desired length to form a desired length of slide fastener. Stops (often referred to as top stops and bottom stops) may be attached to either or both ends of the chain. The stops limit the extent of movement that the slider can undertake along the chain. It is usually the case that a top stop limits movement of the slider in the first sliding direction and a bottom stop limits movement of the slider in the second sliding direction. Typically, stops may be used in order to limit the movement of the slider along the chain. Typically, the slider is no longer able to couple or uncouple elements, or move, when the slider abuts on a stop of some variety, such as a bottom stop or a top stop. The top stop may be configured to abut on a top portion of the slider, for example a top edge of a flange provided on the slider main body, and limit the movement of the slider in the first sliding direction. The bottom stop may be configured to abut on a bottom portion of the slider, for example a bottom edge of a flange provided on the main body of the slider, and limit the movement of the slider in the second sliding direction. Stops may also be configured to abut on the upper or lower blades of the slider.

Some slide fasteners may have a single bottom stop which is attached to both the first and second stringers. Other slide fasteners, which may be referred to as separating slide fasteners, may have two separate bottom stops each attached to a corresponding each one of the stringers. The two bottom stops may take the respective forms of a retainer box and an insertion pin. The insertion pin can be inserted into the retainer box in order to interlink the first and second stringers with one another. Conversely, the insertion pin can be removed from the retainer box when the slider is located adjacent the retainer box in order to pass through the slider and separate the first and second stringers from one another.

Some slide fasteners may have two separate top stops, each being attached to a corresponding one of the stringers. Other slide fasteners may have a single top stop attached to one or both of the stringers.

SUMMARY OF INVENTION

Technical Problem

In certain applications, it is desirable for a slide fastener to be fluid resistant, for example liquid and/or gas tight (i.e. for the slide fastener to substantially prevent the passage of liquid and/or gas through the slide fastener when the slide fastener is in a closed configuration). By further way of example, in some applications, it is desirable for a slide fastener to be watertight, or more specifically, for an article (for example, but not limited to, a garment) of which a watertight slide fastener forms part to be watertight when the slide fastener is in a closed configuration.

Slide fasteners which are not fluid and/or gas tight when the slide fastener is in the closed configuration are not referred to as slide fasteners which are sealable. To the contrary, those slide fasteners which are fluid and/or gas tight when the slide fastener is in the closed configuration are referred to as slide fasteners which are sealable.

It is desirable to provide a watertight slide fastener chain and slide fastener which provides a desired degree of water-tightness while at the same time being relatively easy and cost-effective to manufacture. It is also desirable to provide an alternative watertight slide fastener chain and slide fastener.

Solution to Problem

According to an aspect of the present disclosure, there is provided a slide fastener chain including: a first fastener stringer including a first fastener tape having a first row of coupling elements mounted on a first longitudinal edge of the first fastener tape; a second fastener stringer including a second fastener tape having a second row of coupling elements mounted on a second longitudinal edge of the second fastener tape. The first row of coupling elements is configured to be interdigitated with the second row of coupling elements along a fastener axis in order to secure the first stringer and a second stringer together. Each of the coupling elements of the first and second rows of coupling elements is shaped so as to include a main body having a shoulder portion, and a head portion extending parallel to a lateral axis, perpendicular the fastener axis, and away from the shoulder portion via a neck portion, the head portion including a groove which extends parallel to the fastener axis. The main body of each of the coupling elements of the first row of coupling elements is mounted to the first fastener tape, and the main body of each of the coupling elements of the second row of coupling elements is mounted to the second fastener tape. When the first row of coupling elements is interdigitated with the second row of coupling elements, the first longitudinal edge and second longitudinal edge remain spaced apart, and a first coupling element of the first row of coupling elements is received between two adjacent coupling elements of the second row of coupling elements such that: i) the groove of the first coupling element receives and contacts, in a first contact region, a portion of the second longitudinal edge of the second fastener tape intermediate the adjacent coupling elements of the second row, ii) the head of the first coupling element is received between and contacts, at second and third contact regions respectively, the neck portions of the adjacent coupling elements of the second row, iii) one of the grooves of the adjacent coupling elements of the second row receives and contacts, in a fourth contact region, a first portion of the first longitudinal edge of the first fastener tape adjacent the first coupling element, and iv) the other of the grooves of the adjacent coupling elements of the second row receives and contacts, in a fifth contact region, a second portion of the first longitudinal edge of the first fastener tape adjacent the first coupling element. The first coupling element is intermediate the first and second portions of the first longitudinal edge of the first fastener tape. Contact in each of the first, second, third, fourth and fifth contact regions forms a seal between the first coupling element and each of the adjacent coupling elements, the seal allying the first and second longitudinal edges.

Using the contact between the grooves of the coupling elements on one fastener stringer and the longitudinal edge of the other fastener stringer both facilitates the creation of a seal between the two stringers, but also increases the ability of the coupled fastener stringers to resist unwanted separation due to burst forces (forces generally perpendicular to both the fastener axis and the lateral axis). This is also achieved without the need for any additional features being present on the coupling elements, making the design and manufacture of the coupling elements more straightforward.

The first, second, third, fourth and fifth contact regions may form a continuum. In the continuum, the contact regions may be in order of the fourth contact region, the second contact region, the first contact region, the third contact region and the fifth contact region.

The first contact region, fourth contact region and fifth contact region may extend along an entire length, in a direction parallel to the fastener axis, of the grooves of the first coupling element, the one of the adjacent coupling elements, and the other of the adjacent coupling elements, respectively.

The seal may be a watertight seal such that water or other liquid is substantially prevented from passing between the first coupling element and each of the adjacent coupling elements, and between the first and second longitudinal edges.

A plurality of coupling elements of the first row of coupling elements may each be received between two respective adjacent coupling elements of the second row of coupling elements such that: i) the groove of each first coupling element of the first row receives and contacts, in a first contact region, a respective portion of the second longitudinal edge of the second fastener tape intermediate the respective adjacent coupling elements of the second row, ii) the head of each first coupling element of the first row is received between and contacts, at second and third contact regions respectively, the neck portions of the respective adjacent coupling elements of the second row, iii) the one of the grooves of the respective adjacent coupling elements of the second row receives and contacts, in a fourth contact region, a respective first portion of the first longitudinal edge of the first fastener tape adjacent the respective first coupling element, and iv) the other of the grooves of the respective adjacent coupling elements of the second row receives and contacts, in a fifth contact region, a respective second portion of the first longitudinal edge of the first fastener tape adjacent respective first coupling element. Each first coupling element is intermediate the respective first and second portions of the first longitudinal edge of the first fastener tape. The contact in each of the first, second, third, fourth and fifth contact regions forms a seal between each first coupling element and the respective adjacent coupling elements, the seal allying the first and second longitudinal edges, such that the seal is formed along the entire length of the fastener chain.

The entire length of the fastener chain may be a length, parallel to the fastener axis. The entire length may be measured between an (outboard) edge of a coupling element of the first row of coupling elements (a coupling element of the first row of coupling elements coupling with a coupling element of the second row of coupling elements as described above) located at a first longitudinal end of the fastener chain and i) an (outboard) edge of a coupling element of the second row of coupling elements (a coupling element of the second row of coupling elements coupling with a coupling element of the first row of coupling elements as described above) located at a second longitudinal end of the fastener chain, opposite the first longitudinal end, or ii) an (outboard) edge of a coupling element of the first row of coupling elements (a coupling element of the first row of coupling elements coupling with a coupling element of the second row of coupling elements as described above) located at a second longitudinal end of the fastener chain, opposite the first longitudinal end. An outboard edge of a coupling element located at a first longitudinal end of the fastener chain may be an edge of the coupling element which is located furthest along the longitudinal axis from the second longitudinal end of the fastener chain. An outboard edge of a coupling element located at a second longitudinal end of the fastener chain may be an edge of the coupling element which is located furthest along the longitudinal axis from the first longitudinal end of the fastener chain.

When a seal is formed along the entire length of the fastener chain, then the entire fastener chain may be sealed such that there is no location (where coupling elements of the first row of coupling elements interdigitate with coupling elements of the second row of coupling elements) between the first and second longitudinal edges at which fluid can pass between the first and second longitudinal edges.

The first longitudinal edge of the first fastener tape and the second longitudinal edge of the second fastener tape each take a form of a cord.

Each cord may have a greater thickness in a direction perpendicular to both the fastener axis and the lateral axis than a thickness of the remainder of the fastener tape, which the cord forms part of the fastener tape.

The cord may help to retain the coupling elements on their respective fastener tape. In addition, the cord may provide a greater surface area for the groove of the coupling elements of the other fastener stringer to contact, thereby improving the strength of the contact.

The first fastener tape and second fastener tape may be formed from woven, nonwoven or knitted material.

The first fastener tape and second fastener tape may be coated with and/or impregnated by a plastics or similar material which is impermeable to water.

The configuration of the coupling elements and their locations on the fastener tapes ensure that substantially no water can pass through the fastener chain between the longitudinal edges of the fastener tapes when the coupling elements are interdigitated. Coating and/or impregnating the fastener tapes with a plastics material which is impermeable to water ensures that substantially no water also can pass through the fastener tapes. This means that when the fastener tapes are attached to an article in a watertight manner, substantially no water will be able to pass, either between the longitudinal edges of the fastener stringers or through the fastener tapes themselves, from a first side of the fastener chain to a second side of the fastener chain. This substantially prevents water from entering the article via the fastener chain.

The cord of each of the first and second fastener tapes may be coated with and/or impregnated by a plastics material which is impermeable to water.

The first row of coupling elements may be mounted on the first longitudinal edge of the first fastener tape such that the first longitudinal edge meets the neck portion of each coupling element of the first row of coupling elements.

The second row of coupling elements may be mounted on the second longitudinal edge of the second fastener tape such that the second longitudinal edge meets the neck portion of each coupling element of the second row of coupling elements.

Each coupling element of the first and second rows of coupling elements may include: a first portion mounted to a first face of the fastener tape of the fastener stringer, which the first portion forms part of the fastener stringer, a second portion mounted to a second face, opposed to the first face, of the fastener tape of the fastener stringer, which the second portion forms part of the fastener stringer, and an intermediate portion joining both the first and second portions, the intermediate portion including at least the head portion of the coupling element. The intermediate portion may include at least a portion of the neck portion of the coupling element.

The first portion may only be joined to the second portion by the intermediate portion. In some known slide fasteners, a hole is cut through the tape for each coupling element and each coupling element is attached to its respective tape by the first portion of the coupling element and the second portion of the coupling element being connected via a further intermediate portion that extends through the respective hole in the tape. This may not be necessary for the embodiments of the invention discussed in this application. The only required joining between the first and second portions of each coupling element is via the intermediate portion. This may make the manufacturing process for the slide fastener more straightforward and no holes in the tapes are required.

This facilitates easy manufacture of the fastener chain by allowing the coupling elements to be molded on to or crimped onto their respective fastener tape.

A thickness of the cord of the first fastener stringer in a direction parallel to the lateral axis may be greater than a separation distance in a direction parallel to the lateral axis between the cord of the first fastener stringer and the cord of the second fastener stringer, when the first row of coupling elements is interdigitated with the second row of coupling elements. The cord may be compressed when fastener stringers are closed (i.e. the slide fastener chain is in the closed configuration in which the first and second coupling elements are interdigitated). For example, the cord of one stringer may be compressed by the coupling elements (and, in particular the groove of the coupling elements) of the other stringer.

This may result in the separation distance between the longitudinal edges of the fastener tapes being as small as possible when the coupling elements are interdigitated. This reduces the area between the longitudinal edges of the fastener tapes which needs to be watertight in order for the fastener chain to be watertight. This may improve the sealing effectiveness of the fastener chain. In addition, reducing the separation distance between the longitudinal edges of the fastener tapes may increase the strength of the fastener chain when exposed to a bending force, which is perpendicular to both the fastener axis and the lateral axis. This may increase the ability of the coupled fastener stringers to resist unwanted separation due to such a bending force.

A thickness, in a direction parallel to the lateral axis, of the cord of the first fastener stringer may be greater than a depth, in a direction parallel to the lateral axis, of the groove of the first coupling element. This may ensure better contact between the groove and the cord under compression.

The first coupling element may include a first pressure portion and one of the adjacent coupling elements may include a corresponding second pressure portion. And when the first row of coupling elements is interdigitated with the second row of coupling elements, the first pressure portion may contact the second pressure portion such that the first and second pressure portions undergo compression so as to create a seal therebetween.

The pressure portions help to increase the effectiveness of the seal between the coupling elements.

The first coupling element may include a third pressure portion and the other of the adjacent coupling elements may include a corresponding fourth pressure portion. And when the first row of coupling elements is interdigitated with the second row of coupling elements, the third pressure portion may contact the fourth pressure portion such that the third and fourth pressure portions undergo compression so as to create a seal therebetween.

Again, the pressure portions help to further increase the effectiveness of the seal between the coupling elements.

One or more of the first pressure portion, second pressure portion, third pressure portion and fourth pressure portion may take a form of a protrusion extending in a direction parallel to the fastener axis from the head and/or neck portion of the coupling element, which the relevant pressure portion forms part of the coupling element.

The main body of each of the first coupling elements and the adjacent coupling elements may have a tapered width parallel to the fastener axis, whereby, at a first lateral location, a first width, parallel to the fastener axis, of the main body of the relevant coupling element, adjacent a first face of the fastener tape to which the coupling element is mounted, is greater than, at the first lateral location, a second width, parallel to the fastener axis, of the main body of the relevant coupling element, at a location spaced from and above the first face of the fastener tape to which the coupling element is mounted.

This tapering may help to prevent deformation of the coupling elements when the fastener chain is bent out of plane. This may prevent the watertight seal provided by the fastener chain degrading and/or unwanted separation of interdigitated coupling elements when the fastener chain is bent out of plane.

The first width may be a maximum width of the main body, above the first fastener tape, at the first lateral location and the second width may be a minimum width of the main body, above the first fastener tape, at the first lateral location.

The second width may be between about 40% and 85% of the first width.

The main body of each of the first coupling elements and the adjacent coupling elements may have a tapered width parallel to the fastener axis, whereby, at the first lateral location, a third width, parallel to the fastener axis, of the main body of the relevant coupling element, adjacent a second face of the fastener tape to which the coupling element is mounted, is greater than, at the first lateral location, a fourth width, parallel to the fastener axis, of the main body of the relevant coupling element, at a location spaced from and below the second face of the fastener tape to which the coupling element is mounted.

This tapering may further help to prevent deformation of the coupling elements when the fastener chain is bent out of plane. This may further prevent the watertight seal provided by the fastener chain degrading and/or unwanted separation of interdigitated coupling elements when the fastener chain is bent out of plane.

The third width may be a maximum width of the main body, below the first fastener tape, at the first lateral location and the fourth width may be a minimum width of the main body, below the first fastener tape, at the first lateral location.

The fourth width may be between about 40% and 85% of the third width.

The first coupling element and the adjacent coupling elements may be formed from the plastics material which is impermeable to water.

The first coupling element and the adjacent coupling elements may be formed from a different material from a material which is used to coat/impregnate the first fastener tape, second fastener tape and/or cords.

Forming the coupling elements from the same material that the fastener tapes are coated and/or impregnated with may increase the adhesion strength between the fastener tapes and their respective coupling elements.

Each of the first coupling element and the adjacent coupling elements may be formed from a material whereby Young's Modulus for each of the first coupling element and the adjacent coupling elements is between about 1000 and about 2000.

This may help to improve the effectiveness of the seal between the coupling elements. This may be because, the more it is possible to compress the coupling elements, the more tolerant the fastener chain is to be bent whilst the relevant coupling elements and fastener tapes maintain contact.

The first coupling element of the first row of coupling elements and the two adjacent coupling elements of the second row of coupling elements may be substantially identical in shape. Each of the coupling elements of the first row of coupling elements and the second row of coupling elements may be substantially identical in shape.

According to a second aspect of the invention, there is provided a slide fastener including the slide fastener chain according to the first aspect of the invention and a slider movably mounted on the first and second fastener stringers, such that the slider is movable relative to the first and second fastener stringers along the fastener axis. The slider may move in a first direction in order to interdigitate the first row of coupling elements of the first fastener stringer with the second row of coupling elements of the second fastener stringer in order to secure the first fastener stringer and the second fastener stringer together, and may move in a second direction in order to decouple the first row of coupling elements of the first fastener stringer from the second row of coupling elements of the second fastener stringer in order to decouple the first fastener stringer and the second fastener stringer.

Such a slide fastener has all the advantages of a fastener chain according to the first aspect of the invention.

The slide fastener may further include at least one top stop configured to provide a limit of movement of the slider along the fastener axis in the first direction; and/or a bottom stop configured to provide a limit of movement of the slider along the fastener axis in the second direction.

According to a third aspect of the invention, there is provided an article including a slide fastener according to the second aspect of the invention.

It should be recognized that features discussed above in relation to one aspect of the invention may, where appropriate, be applied in relation to any other aspect of the invention.

DESCRIPTION OF EMBODIMENTS

Equivalent features shown within the figures have been labelled with the same reference numbers.

Figure 1:
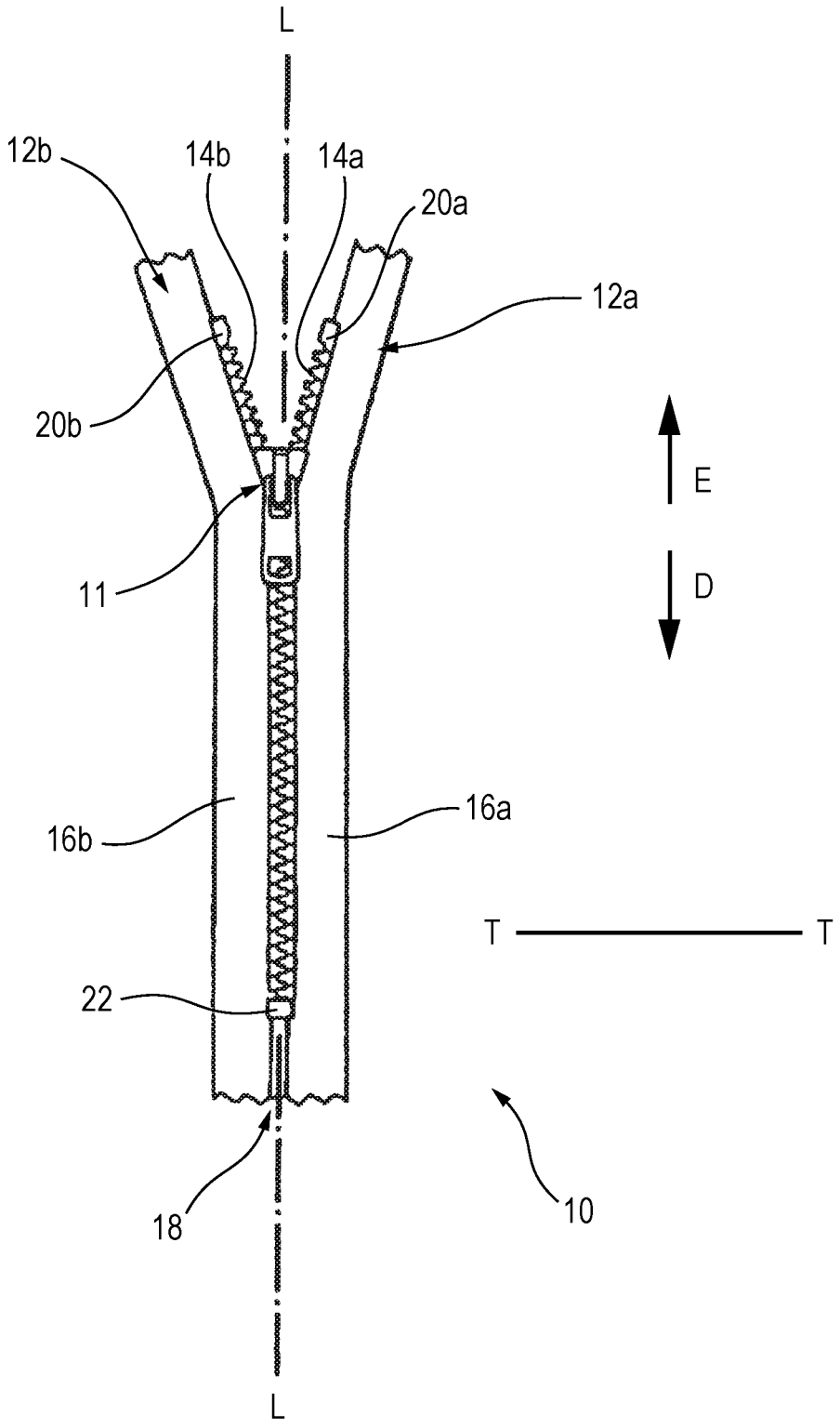
FIG. 1 is a plan view of a portion of a known slide fastener.

FIG. 1 shows a known slide fastener 10. The slide fastener includes a slider 11 and a pair of stringers 12*a*, 12*b*. Each stringer 12*a*, 12*b* includes a coupling portion in the form of a plurality of coupling elements 14*a*, 14*b* (also referred to as teeth) which are attached to a tape 16*a*, 16*b*, in particular a longitudinal coupling edge of the tape 16*a*, 16*b*. The tape may be woven or knitted and may be formed from, for example, synthetic fibers such as polyester, vinylon or polyurethane and/or natural fibers such as cotton. The coupling elements 14*a*, 14*b* may be attached to their respective tape 16*a*, 16*b* by, for example, crimping or molding the coupling elements onto a reinforced coupling edge of the tape 16*a*, 16*b*. The reinforced edges of the tapes may take the form of a cord having a thickness which is greater than that of the tape, as is well known in the art.

The two stringers 12*a*, 12*b* when brought together (as shown in the bottom portion of FIG. 1), are such that the coupling elements 14*a*, 14*b* of each stringer 12*a*, 12*b* are attached to one another, by interdigitating, to form chain 18. The chain 18 is generally planar, and the chain 18 (and the coupling portions which form part of the chain 18) extends along a longitudinal axis (or fastener axis) L of the chain 18.

Each of the coupling elements 14*a*, 14*b* includes head and neck portions. When the coupling elements 14*a* and 14*b* are brought together such that they interdigitate, the head and neck portions of the coupling elements 14*a* of the first stringer 12*a* cooperate with the head and neck portions of the coupling elements 14*b* of the second stringer 12*b* to prevent lateral separation in a direction generally parallel to a lateral axis T of the coupling elements 14*a*, 14*b*.

The slider 11 is mounted to the chain 18 such that it can move along the chain 18 between the two stringers 12*a*, 12*b*. Movement of the slider 11 along the chain 18 in a first sliding direction E causes the coupling elements 14*a* of the first stringer 12*a* to attach to the coupling elements 14*b* of the second stringer 12*b*. Whereas movement of the slider along the chain in a second sliding direction D, opposite to the first sliding direction E, causes the coupling elements 14*a* of the first stringer 12*a* to detach from the coupling elements 14*b* of the second stringer 12*b*.

The chain 18 is commonly cut to a desired length to form a desired length of slide fastener 10. Stops (often referred to as top stops and bottom stops) are attached to either end of the chain 18. The stops limit the extent of movement that the slider 11 can undertake along the chain 18.

In the slide fastener shown in FIG. 1, the stops 20*a* and 20*b* are top stops attached to a top end of the chain 18 on the first tape 16*a* and second tape 16*b* respectively. Other slide fasteners may have a single top stop attached to both stringer tapes. The top stops may be formed from any suitable material, for example, they may include a polymer material such as polyester, polyacetal, or polyethylene, or they may be metal based, such as aluminium, nickel or the like or alloys of such metals.

The slide fastener has a single bottom stop 22 which is attached to the tapes 16*a*, 16*b* of both the first and second stringers 12*a*, 12*b* and which secures the tapes 16*a* and 16*b* together.

Figure 2:
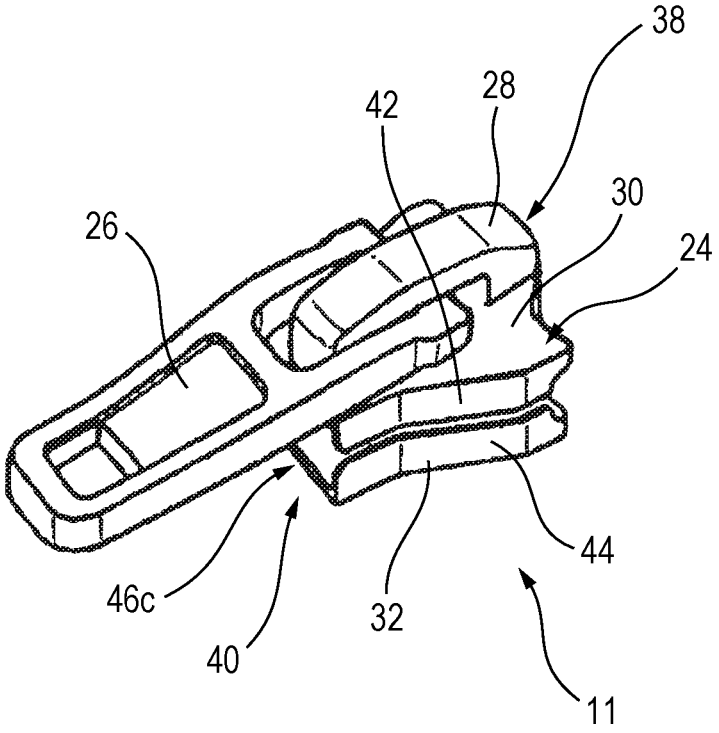
FIG. 2 is a perspective view of a slider of a known slide fastener.

As shown in FIG. 2, the slider 11 includes a main body 24, through which the coupling elements 14*a*, 14*b* of each stringer 12*a*, 12*b* pass, and a pull tab 26 attached to the main body 24 via a bridge portion 28. The pull tab 26 may be grasped by a user in order to effectively move the slider 11 along the chain 18 (for example, in the first and second sliding directions E, D as previously discussed).

In more detail, the main body 24 of the slider 11 includes an upper portion 30 connected to a lower portion 32 by a connection post (not shown) extending in a direction perpendicular to both the fastener axis L and lateral axis T. The upper portion 30 may be referred to as an upper wing or an upper blade. Likewise, the lower portion may be referred to as a lower wing or lower blade. The connection post may be referred to as the diamond.

The upper portion 30, lower portion 32 and connection post co-operate to define a Y-shaped channel within the slider. The Y-shaped channel is also defined by lateral flanges 42 and 44 on either side of the slider 11 which extend towards each other from the upper portion 30 and lower portion 32 respectively. In FIG. 2, only one set of lateral flanges 42 and 44 is visible, and another set is provided on the reverse side of the slider which is not visible in the figure. The Y-shaped channel has a first arm separated from a second arm by the connection post.

The slider 11 extends in direction D, when mounted to the chain, from a head end 38 of the slider to a tail end 40 of the slider 11. The Y-shaped channel also includes a third arm which adjoins the first and second arms in the vicinity of a tail end of the connection post.

The first arm and second arm have respective first and second openings (not shown) at the head end 38 of the slider 11. The third arm has a third opening 46*c* at the tail end 40 of the slider 11.

Figure 3:
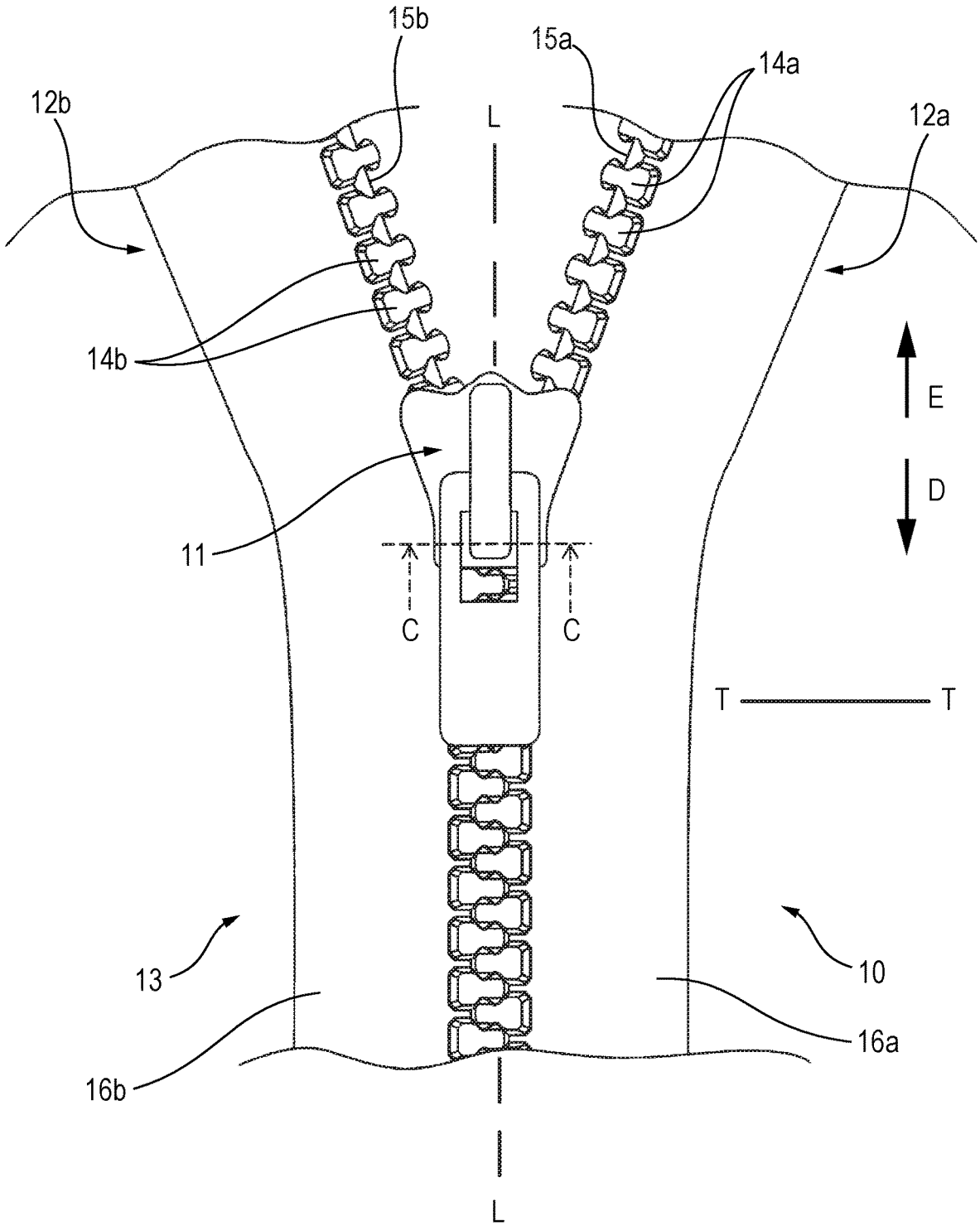
FIG. 3 is a plan view of a portion of a slide fastener in accordance with an embodiment of the present invention.

FIG. 3 shows a portion of a slide fastener 10 according to the present invention. The slide fastener 10 includes a slide fastener chain 13 according to the invention, including first fastener stringer 12*a* and second fastener stringer 12*b*, upon which is mounted a slider 11.

The first fastener stringer 12*a* includes a first fastener tape 16*a* having a first row of coupling elements 14*a* mounted on a first longitudinal edge 15*a* of the first fastener tape 16*a*.

The second fastener stringer 12*b* includes a second fastener tape 16*b* having a second row of coupling elements 14*b* mounted on a second longitudinal edge 15*b* of the second fastener tape 16*b*.

As previously discussed, the first row of coupling elements 14*a* may be interdigitated with the second row of coupling elements 14*b* along a fastener axis L in order to secure the first stringer 12*a* and a second stringer 12*b* together.

The slider 11 is movably mounted on the first and second fastener stringers 12*a*, 12*b*, such that the slider 11 is movable relative to the first and second fastener stringers 12*a*, 12*b* along the fastener axis L.

The slider is movable in a first direction E in order to interdigitate the first row of coupling elements 14*a* of the first fastener stringer 12*a* with the second row of coupling elements 14*b* of the second fastener stringer 12*b* in order to secure the first fastener stringer 12*a* and the second fastener stringer together 12*b*.

The slider 11 is also movable in a second direction D in order to decouple the first row of coupling elements 14*a* of the first fastener stringer 12*a* from the second row of coupling elements 14*b* of the second fastener stringer 12*b* in order to decouple the first fastener stringer 12*a* and the second fastener stringer 12*b*.

Although not shown in FIG. 3, like in FIG. 1, a slide fastener 10 according to the present invention may be provided with at least one top stop 20*a*, 20*b* configured to provide a limit of movement of the slider 11 along the fastener axis L in the first direction E. Alternatively or in addition, the slide fastener 10 may be provided with a bottom stop 22 configured to provide a limit of movement of the slider 11 along the fastener axis L in the second direction D.

In the present embodiment, all the coupling elements 14*a* of the first stringer 12*a* are identical to each other and to the coupling elements 14*b* of the second stringer 12*b*. This need not always be the case.

FIGS. 4, 5, 6 and 7 show perspective, plan, front and side cross-sectional views of a portion of a fastener stringer including three coupling elements. These figures are labelled such that the portion of the fastener stringer shown in these figures is a portion of the second stringer 12*b*, having coupling elements 14*b*. However, it will be understood that, given the coupling elements 14*a* of the first stringer 12*a* are identical to the coupling elements 14*b* of the second stringer 12*b*, these figures are equally applicable to the first stringer and its coupling elements.

Figure 5:
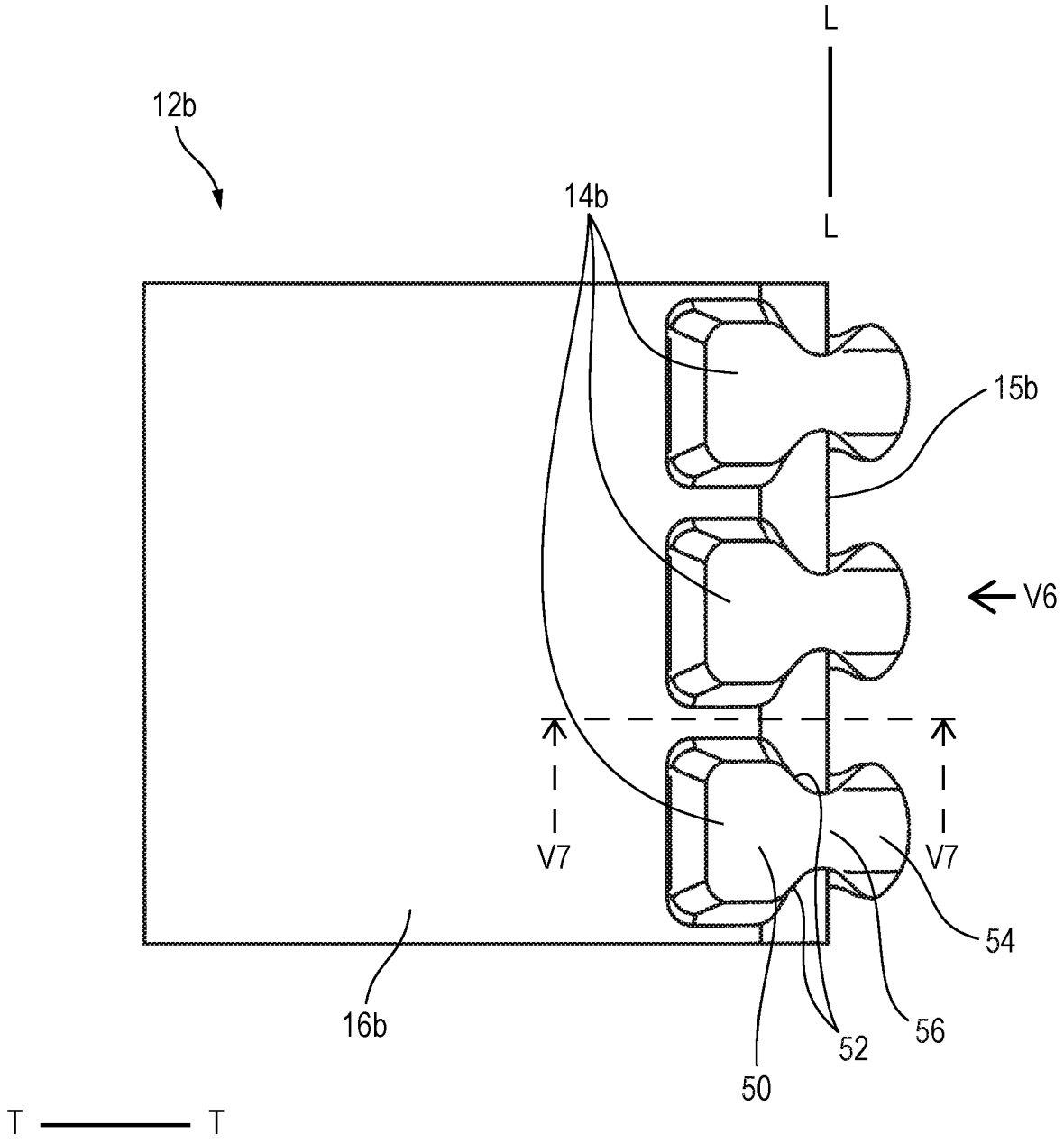
FIG. 5 is a plan view of the portion of the stringer shown in FIG. 4.
Figure 6:
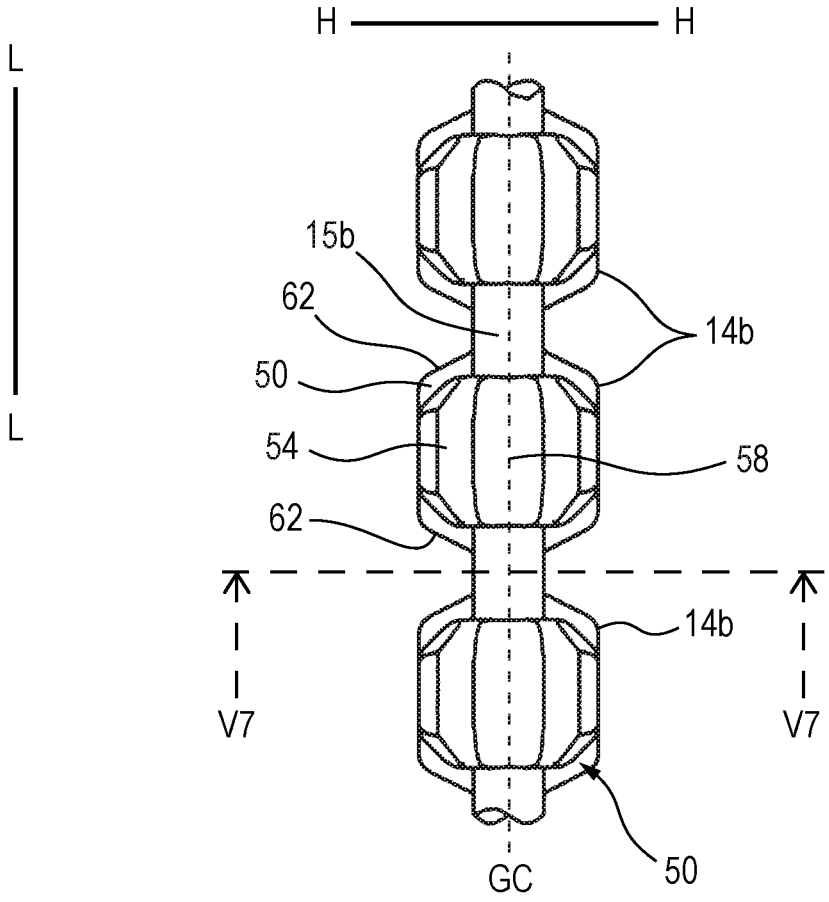
FIG. 6 is a front view of the portion of the stringer shown in FIGS. 4 and 5.
Figure 7:
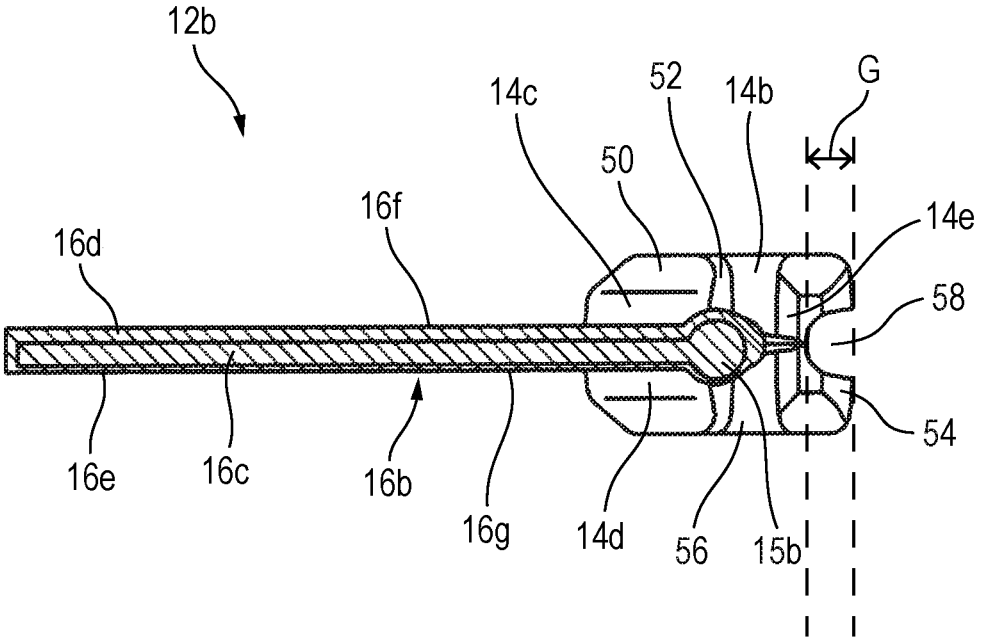
FIG. 7 is a side cross-sectional view of the portion of the stringer shown in FIGS. 4 to 6.

The front view of FIG. 6 is that which is seen when the portion of the stringer 12*b* is viewed in the direction V6 as shown in FIG. 5. The side cross-sectional view of FIG. 7 is taken in the plane and direction V7 as shown in FIGS. 5 and 6.

Figure 4:
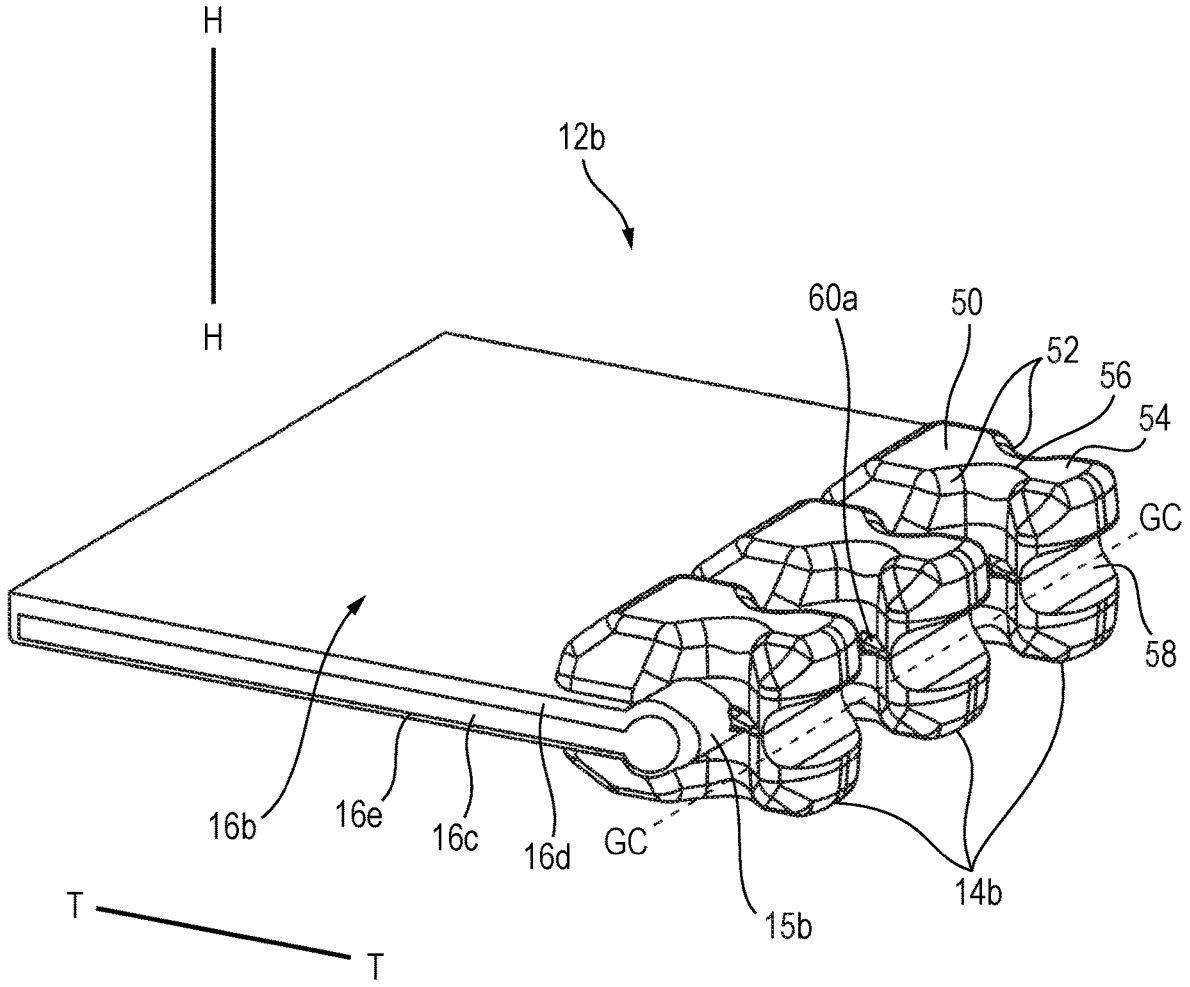
FIG. 4 is a perspective view of a portion of a stringer of the slide fastener of FIG. 3.

As can be seen best in FIGS. 4 and 5, each of the coupling elements 14*b* of second row of coupling elements (and equally applicable to the coupling elements 14*a* of the first row of coupling elements) is shaped such that they include a main body 50 having a shoulder portion 52, and a head portion 54 extending parallel to a lateral axis T, perpendicular the fastener axis L, and away from the shoulder portion 52 via a neck portion 56.

The head portion 54 includes a groove 58 which extends parallel to the fastener axis L. The groove 58 is located at the center of the height of the coupling element, the height being measured along axis H, which is perpendicular to both the fastener axis L and the lateral axis T. The groove 58 is located at the same height as the edge 15*b* of the fastener tape 16*b* upon which the coupling element 14*b* is mounted. In particular, a central axis GC of the groove 58 is located at the same height as the edge 15*b* of the fastener tape 16*b* upon which the coupling element 14*b* is mounted. Put another way, the groove 58 is located in the plane of the fastener tape 16*b* upon which the coupling element 14*b* is mounted. The groove 58 has a generally semi-circular or c-shaped profile when viewed along the fastener axis, as in FIG. 7. It will be understood that, in other embodiments, the groove may have any appropriate cross-sectional shape/profile.

The main body 50 of each of the coupling elements 14*a* of the first row of coupling elements 14*a* is mounted to the first fastener tape 16*a*, and the main body 50 of each of the coupling elements 14*b* of the second row of coupling elements 14*b* is mounted to the second fastener tape 16*b*.

The first row of coupling elements 14*a* are mounted on the first longitudinal edge 15*a* of the first fastener tape 16*a* such that the first longitudinal edge 15*a* meets the neck portion 56 of each coupling element 14*a* of the first row of coupling elements. Likewise, as seen best in FIGS. 4 and 5, the second row of coupling elements 14*b* are mounted on the second longitudinal edge 15*b* of the second fastener tape 16*b* such that the second longitudinal edge 15*b* meets the neck portion 56 of each coupling element 14*b* of the second row of coupling elements. In other words, the first row of coupling elements 14*a* are mounted on the first longitudinal edge 15*a* of the first fastener tape 16*a* such that the first longitudinal edge 15*a* is enclosed within the neck portion 56 of each coupling element 14*a* of the first row of coupling elements. Likewise, the second row of coupling elements 14*b* are mounted on the second longitudinal edge 15*b* of the second fastener tape 16*b* such that the second longitudinal edge 15*b* is enclosed within the neck portion 56 of each coupling element 14*b* of the second row of coupling elements. In embodiments in which the first and second longitudinal edges of the fastener tapes include a cord, at least a portion of the cord of the first longitudinal edge is enclosed within the neck portion of each coupling element of the first row of coupling elements, and at least a portion of the cord of the second longitudinal edge is enclosed within the neck portion of each coupling element of the second row of coupling elements. In some embodiments, the entire thickness (parallel to the lateral axis) of the cord of the first longitudinal edge is enclosed within the neck portion (or neck portion and main body) of each coupling element of the first row of coupling elements, and the entire thickness (parallel to the lateral axis) of the cord of the second longitudinal edge is enclosed within the neck portion (or neck portion and main body) of each coupling element of the second row of coupling elements.

The above examples differ from many known slide fastener chains in which the first row of coupling elements 14*a* are mounted on the first longitudinal edge 15*a* of the first fastener tape 16*a* such that the first longitudinal edge 15*a* (or, if present, entire thickness of the cord) is enclosed within the main body of each coupling element 14*a* of the first row of coupling elements, and the second row of coupling elements 14*b* are mounted on the second longitudinal edge 15*b* of the second fastener tape 16*b* such that the second longitudinal edge 15*b* (or, if present, entire thickness of the cord) is enclosed within the main body of each coupling element 14*b* of the second row of coupling elements.

As shown best in FIG. 7 each coupling element 14*a*, 14*b* of the first and second rows of coupling elements includes a first portion 14*c* mounted to a first (upper) face 16*f* of the fastener tape 16*a*, 16*b* of the fastener stringer 12*a*, 12*b* of which it forms part. Furthermore, each coupling element 14*a*, 14*b* of the first and second rows of coupling elements includes a second portion 14*d* mounted to a second (lower) face 16*g*, opposed to the first face 16*f*, of the fastener tape 16*a*, 16*b* of the fastener stringer 12*a*, 12*b* of which it forms part. An intermediate portion 14*e* of each coupling element 14*a*, 14*b* joins both the first and second portions 14*c*, 14*d* of the coupling elements 14*a*, 14*b*. The intermediate portion 14*e* includes at least the head portion 54 of the coupling element 14*a*, 14*b*. The intermediate portion 14*e* may also include at least a part of the neck portion 56 of the coupling element 14*a*, 14*b*.

Figure 8:
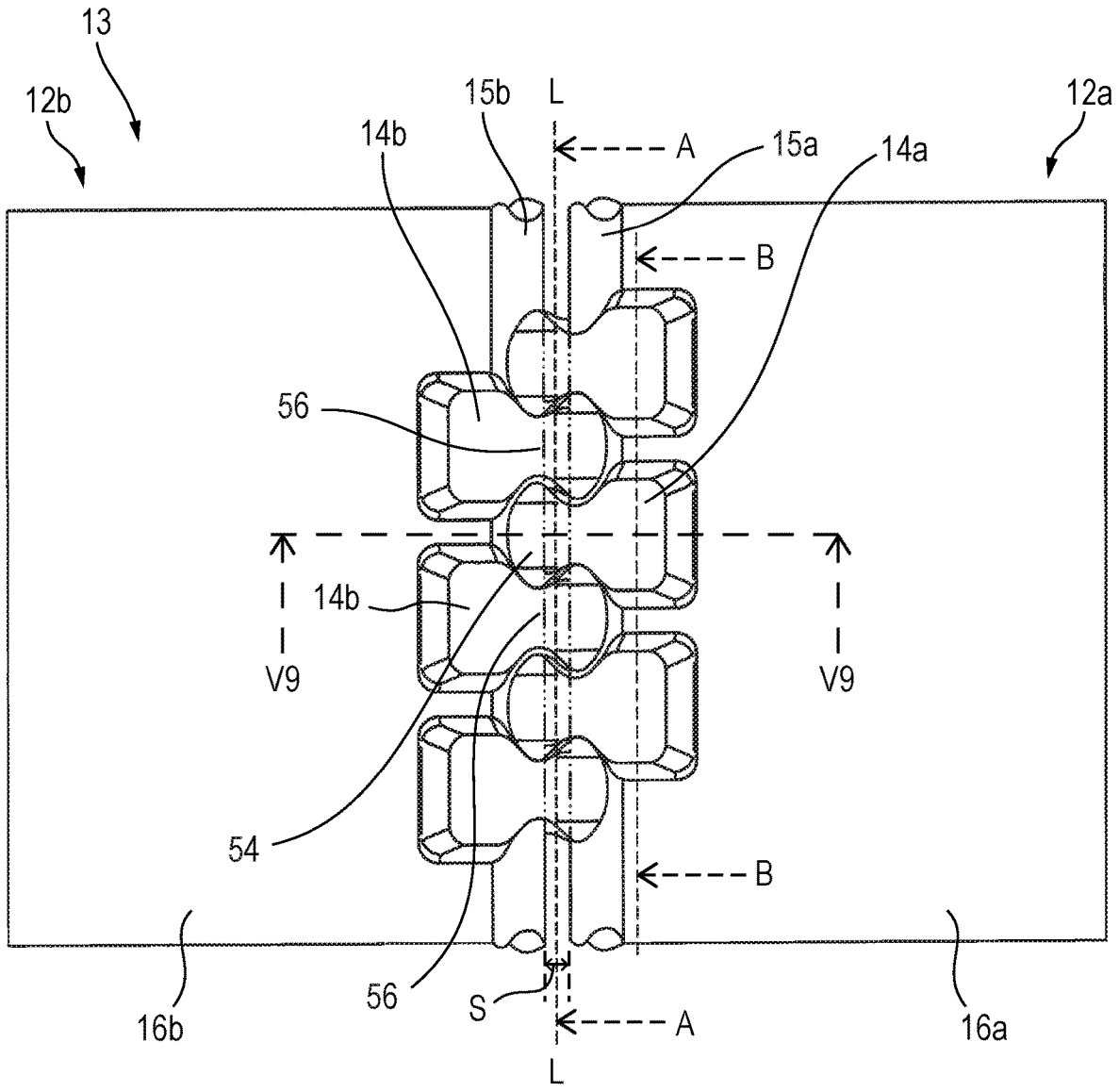
FIG. 8 is a plan view of a portion of the fastener chain of the slide fastener shown in FIG. 3 (some coupling elements of the slide fastener are not shown, so as to aid clarity).
Figure 9:
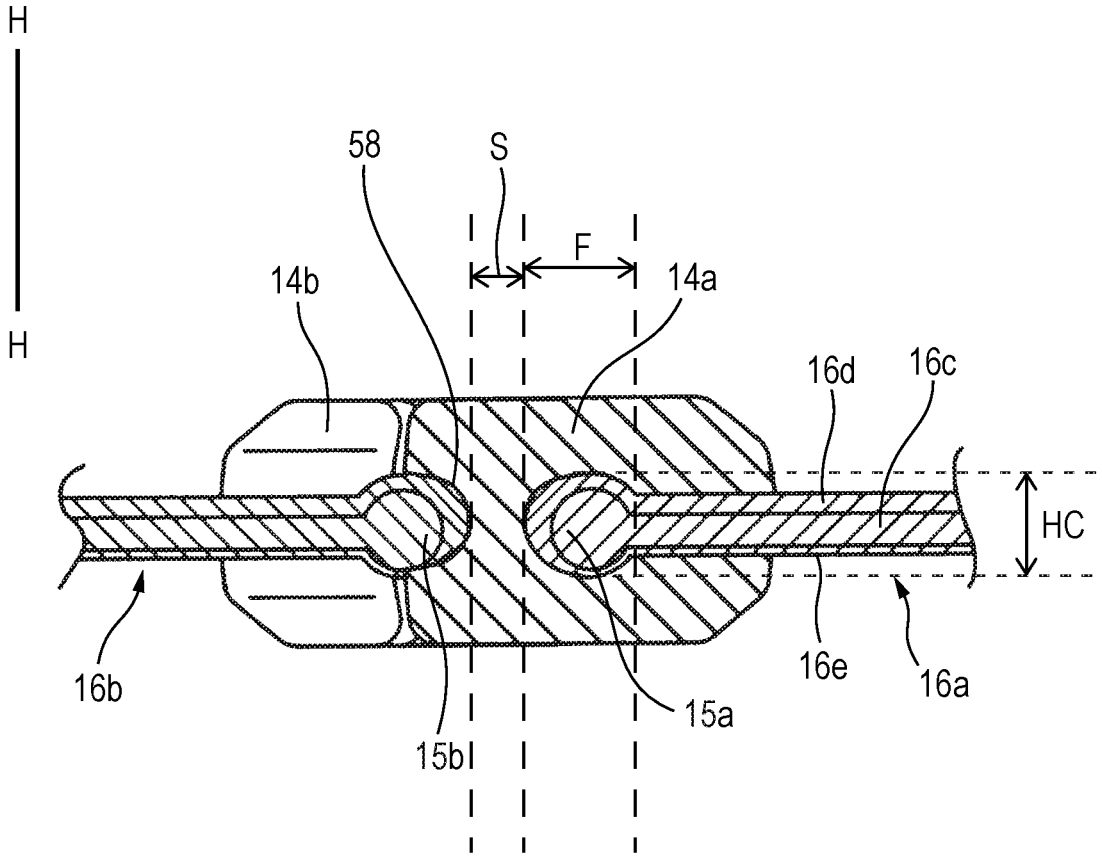
FIG. 9 is a side cross-sectional view of the portion of the fastener chain shown in FIG. 8.
Figure 10:
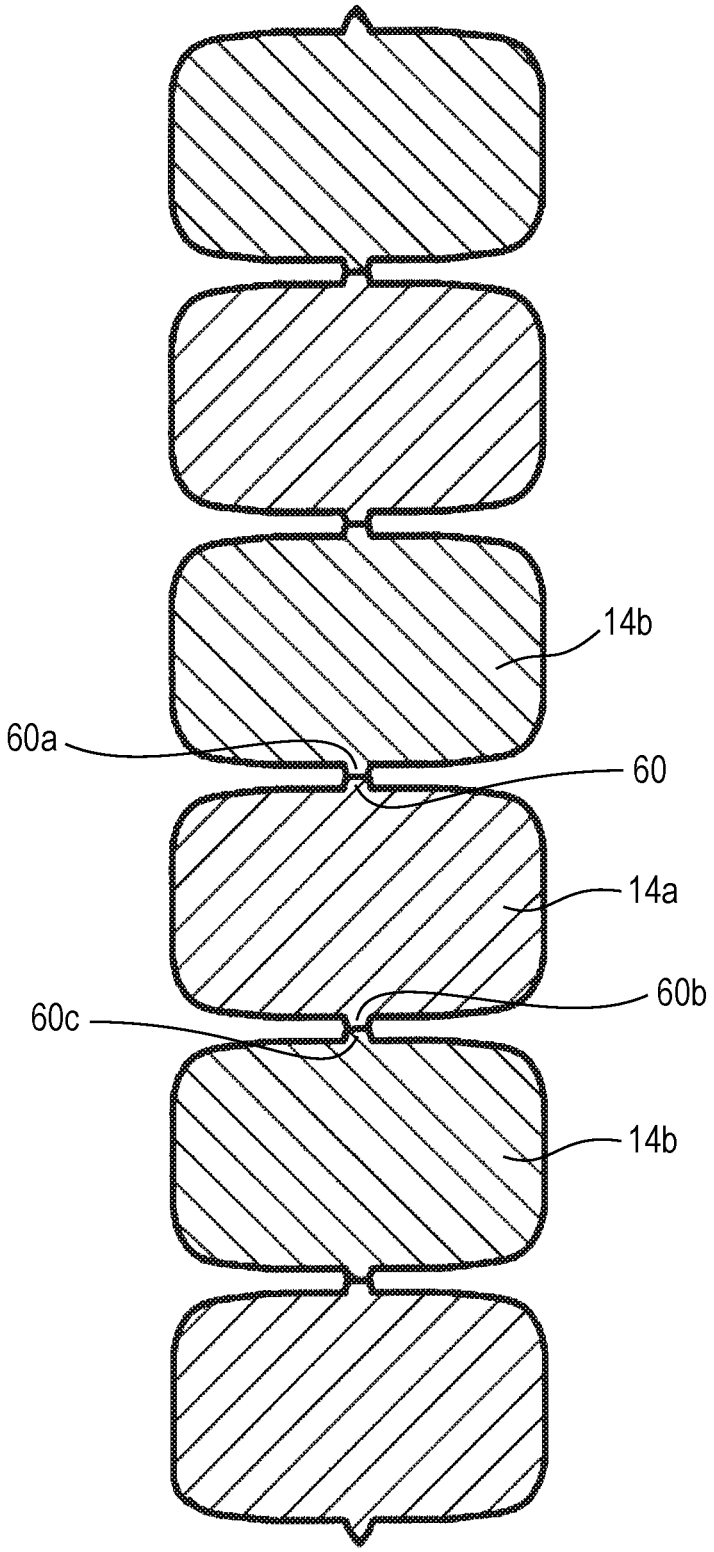
FIG. 10 is a partial front cross-sectional view of the portion of the fastener chain shown in FIGS. 8 and 9.
Figure 11:
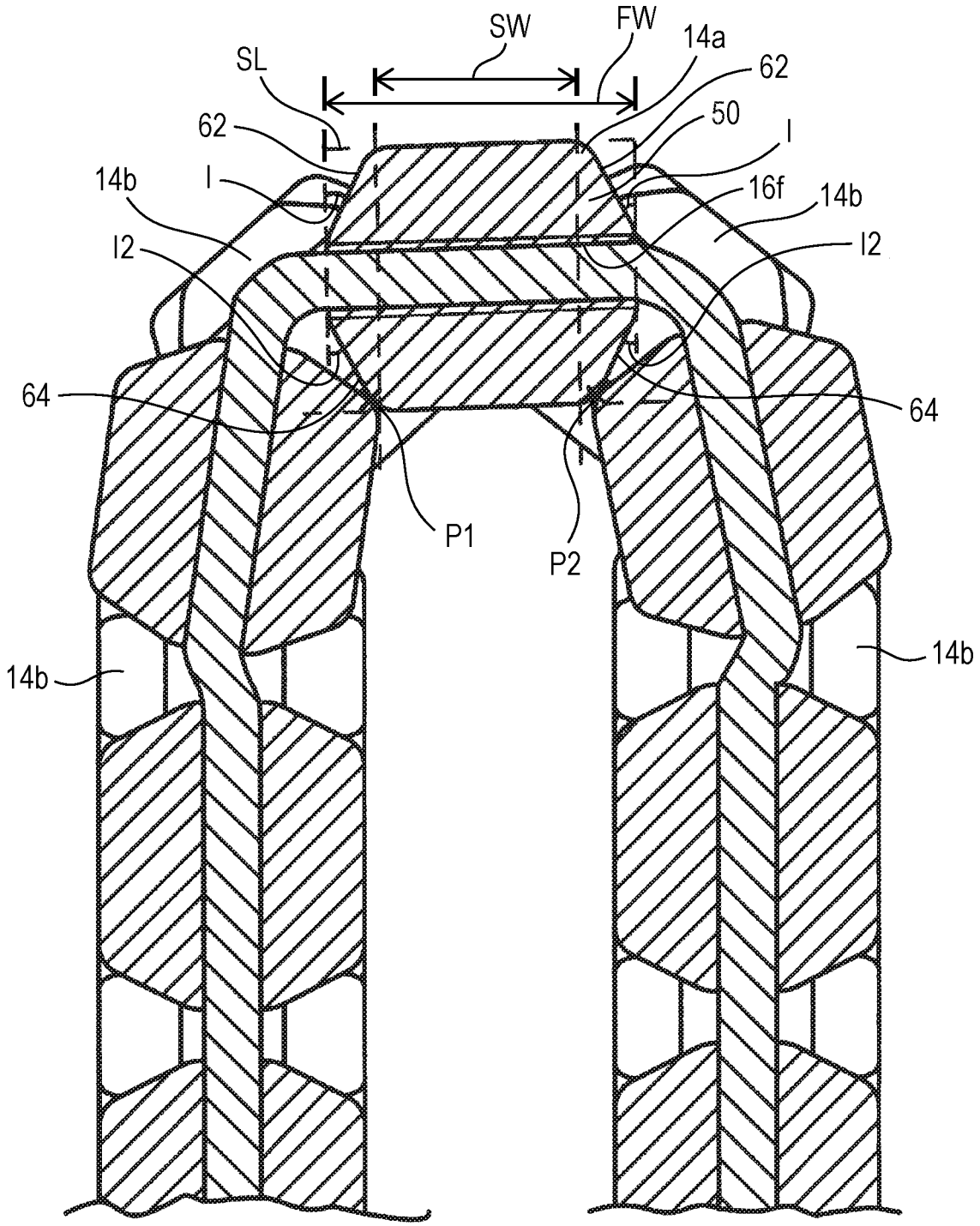
FIG. 11 is a front cross-sectional view of a portion of the fastener chain of the slide fastener shown in FIG. 3, the portion of the fastener chain being bent out of plane.
Figure 12:
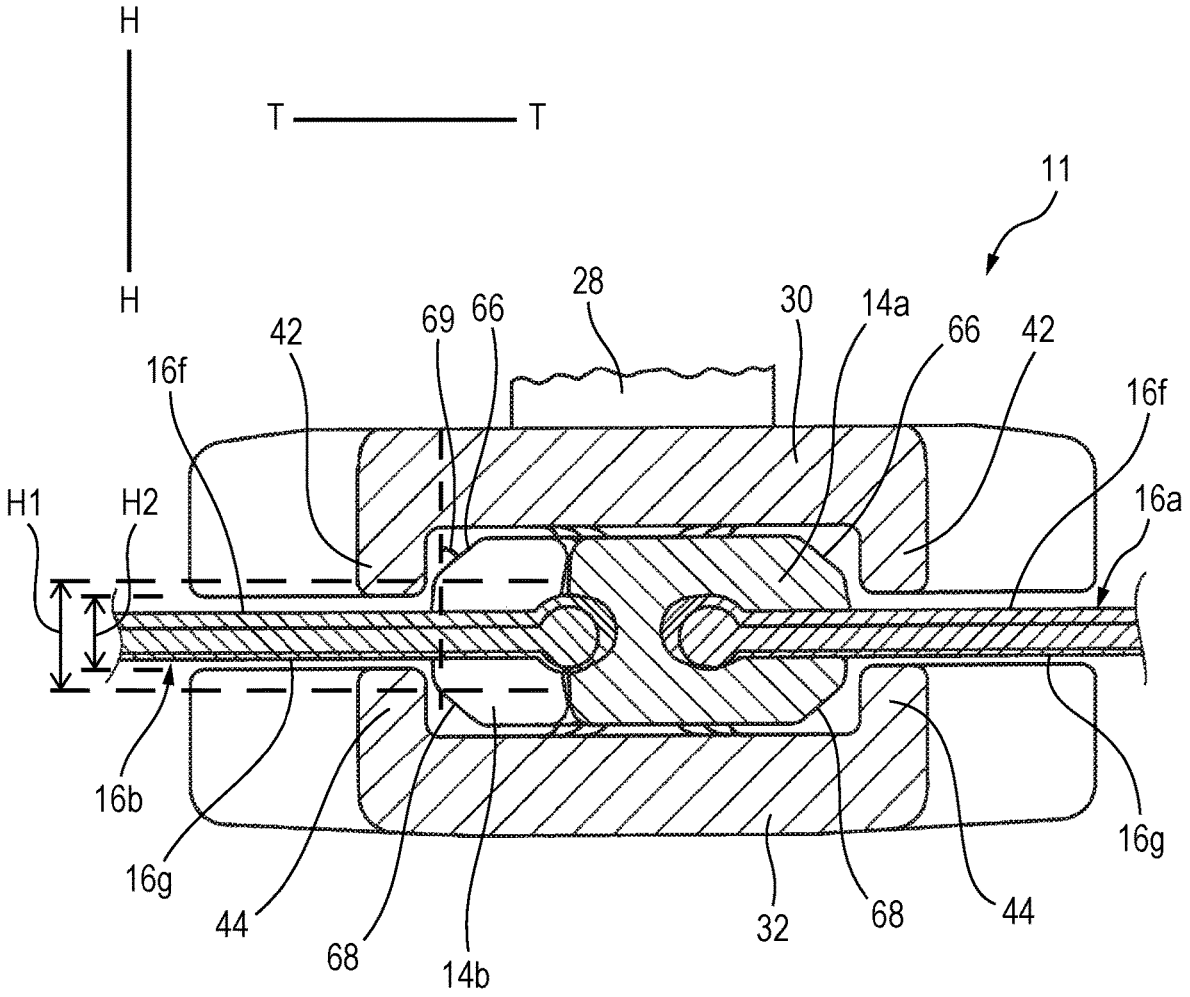
FIG. 12 is a side cross-sectional view of a portion of the slide fastener as shown in FIG. 3.

FIGS. 8, 9, 10, 11 and 12 show views of the slide fastener chain or slide fastener when the first row of coupling elements 14*a* is interdigitated with the second row of coupling elements 14*b*. FIG. 8 shows a plan view of a portion of the slide fastener chain 13 in which some coupling elements at the top and bottom ends (in the sense of the figure) have been removed to aid the clarity of the figure. FIG. 9 shows a side cross-sectional view in the plane and direction indicated by V9 in FIG. 8. FIG. 10 shows a front cross-sectional view in the plane and direction indicated by A-A in FIG. 8. FIG. 11 shows a front cross-sectional view in the plane and direction indicated by B in FIG. 8. In FIG. 11, as will be discussed in more detail at a later point, the chain has been bent such that it is no longer planar. FIG. 12 shows a side cross-sectional view, similar to that of FIG. 9, of a slide fastener including a slider, in the plane and direction indicated by C in FIG. 3.

As can be seen most clearly in FIGS. 8 and 9, when the first row of coupling elements 14*a* is interdigitated with the second row of coupling elements 14*b*, the first longitudinal edge 15*a* and second longitudinal edge 15*b* remain spaced apart, by a separation distance S. This differs from some known sealing slide fasteners in which, when its coupling elements are interdigitated, the longitudinal edges of the first and second fastener tapes contact one another to form a seal. Given that, in the present invention, the fastener chain cannot have a seal formed by contact between the longitudinal edges of the first and second fastener tapes, the seal must be formed in another manner. This is discussed in more detail below.

Again, as can be seen most clearly in FIGS. 8 and 9, when the first row of coupling elements 14*a* is interdigitated with the second row of coupling elements 14*b*, a first coupling element 14*a* of the first row of coupling elements 14*a* is received between two adjacent coupling elements 14*b* of the second row of coupling elements 14*b*, such that several things occur.

First, the groove 58 of the first coupling element 14*a* receives and contacts, in a first contact region, a portion of the second longitudinal edge 15*b* of the second fastener tape 16*b* intermediate the adjacent coupling elements 14*b*.

Secondly, the head portion 54 of the first coupling element 14*a* is received between and contacts, at second and third contact regions respectively, the neck portion 56 of each of the adjacent coupling elements 14*b*.

Thirdly, one of the grooves 58 of the adjacent coupling elements (e.g. the upper of the two coupling elements labelled 14*b* in FIG. 8) receives and contacts, in a fourth contact region, a first portion of the first longitudinal edge 15*a* of the first fastener tape 16*a* adjacent the first coupling element 14*a*.

Fourthly, the other of the grooves 58 of the adjacent coupling elements (e.g. the lower of the two coupling elements labelled 14*b* in FIG. 8) receives and contacts, in a fifth contact region, a second portion of the first longitudinal edge 15*a* of the first fastener tape 16*a* adjacent the first coupling element 14*a*. The first coupling element 14*a* is intermediate the first and second portions of the first longitudinal edge 15*a* of the first fastener tape 16*a*.

The contact in each of the first, second, third, fourth and fifth contact regions forms a seal such that water is substantially prevented from passing (for example in a direction along axis H) between the first coupling element 14*a* and each of the adjacent coupling elements 14*b*, and hence between the spaced apart first and second longitudinal edges 15*a*, 15*b*.

It will be understood that, for ease of explanation, the above description makes reference to the seal formed between one of the coupling elements of the first stringer and the respective two adjacent coupling elements of the second stringer which receive the coupling element of the first stringer when the coupling elements interdigitate. In practice, the same seal will be formed between each coupling element of the first stringer and the respective two adjacent coupling elements of the second stringer which receive said coupling element of the first stringer when the coupling elements interdigitate. In this way, a seal is created between all of the coupling elements of the first and second stringers along the entire length (parallel to the fastener axis) of the interdigitated coupling elements.

The contact between the grooves of the coupling elements on one fastener stringer and the longitudinal edge of the other fastener stringer, when the coupling elements are interdigitated, facilitates the creation of a seal between the two stringers, and also increases the ability of the coupled fastener stringers to resist unwanted separation due to lateral forces (in direction H, generally perpendicular to both the fastener axis and the lateral axis). This is also achieved without the need for any additional features being present on the coupling elements (such as the presence of retaining flanges on the shoulders of known coupling elements), making the design and manufacture of coupling elements, and hence a fastener chain according to the present invention more straightforward.

In a seal as discussed above, it will be understood that the seal may be fluid tight, e.g. watertight.

As is best visible in FIG. 8, the first longitudinal edge 15*a* of the first fastener tape 16*a* and the second longitudinal edge 15*b* of the second fastener tape 16*b* each take the form of a cord having a greater thickness in a direction perpendicular to both the fastener axis and the lateral axis (i.e. in direction H) than that of the remainder of the fastener tape of which the cord forms part. As seen best in FIG. 9, when viewed in cross-section along the fastener axis, whilst the cords 15*a*, 15*b* have a generally circular cross-section, the cross-section of the remainder of the tapes 16*a*, 16*b* is generally rectangular or straight. The cord may be referred to as a reinforced edge of the tape. The cord may be sewn or woven into the tape in a manner which is well known in the art. In embodiments with a cord, the longitudinal edges of the fastener tapes are formed by the cords. As such, the terms cords and longitudinal edges can be used interchangeably in embodiments including cords.

As best seen in FIGS. 4, 7 and 9, each fastener tape 16*a*, 16*b* has a generally laminated structure. Each tape 16*a*, 16*b* is formed from a core 16*c* of woven, nonwoven or knitted material. The core 16*c* may be formed from, for example, synthetic fibers such as polyester, vinylon or polyurethane and/or natural fibers such as cotton. The core 16*c* may be water permeable.

The core 16*c* of each tape 16*a*, 16*b* is coated with and/or impregnated by a plastics material which is impermeable to water. The coating may be applied in any appropriate manner, for example, but not limited to, extruding the coating onto the core. Any appropriate water impermeable material may be used. In one example the coating material is polyurethane.

As shown in FIGS. 4, 7 and 9, the coating takes the form of a first coating layer 16*d* located above the core 16*c*, and a second coating layer 16*e* located below the core 16*c*. In the embodiment shown, both the first and second coating layers are formed from the same material. In the embodiment shown, the first coating layer 16*d* is thicker in direction H than the second coating layer 16*e*. This is because, in use, it is intended that the upper surface of the chain 13 may be exposed to water. As such, it follows that the upper first coating layer 16*d* is thicker than the lower second coating layer 16*e*, as the requirement that the first coating layer is water impermeable is greater than that for the second coating layer, and greater layer thickness will result in greater water impermeability. A thin second coating layer may ensure greater flexibility in the fastener tape.

In other embodiments, the second coating layer may be formed from a different material as compared to the first coating layer, the second coating layer may be the same thickness as or thicker than the first coating layer, or the second coating layer may not be present at all.

It can be seen that the cord 15*a*, 15*b* of each of the first and second fastener tapes 16*a*, 16*b* is coated with and/or impregnated by a plastics material which is impermeable to water. In the present embodiment, the first coating layer 16*d* extends around the cord 15*a*, 15*b* to adjoin the second coating layer 16*e*. Coating and/or impregnating the cords 15*a*, 15*b* with a plastics material not only makes the cords 15*a*, 15*b* water impermeable, but may also increase the resilience of the cords 15*a*, 15*b*.

Increasing the resilience of the cords 15*a*, 15*b* may increase the sealing force exerted by the cords 15*a*, 15*b* on the grooves of the coupling elements where they contact when the coupling elements interdigitate. This may increase the sealing effectiveness of the seal created between the cords 15*a*, 15*b* and the coupling elements 14*b*, 14*a*.

As best shown in FIG. 9, the thickness F of the cord 15*a* (including any coating, if present) of the first fastener stringer 12*a* in a direction parallel to the lateral axis T is greater than a separation distance S in a direction parallel to the lateral axis T between the cord 15*a* of the first fastener stringer 12*a* and the cord 15*b* of the second fastener stringer 12*b*, when the first row of coupling elements 14*a* is interdigitated with the second row of coupling elements 14*b*.

This may result in the separation distance S between the longitudinal edges 15*a*, 15*b* of the fastener tapes 16*a*, 16*b* being as small as possible when the coupling elements 14*a*, 14*b* are interdigitated. This reduces the area between the longitudinal edges 15*a*, 15*b* of the fastener tapes 16*a*, 16*b* which needs to be watertight in order for the fastener chain 13 to be watertight. This may improve the sealing effectiveness of fastener chain 13. In addition, reducing the separation distance S between the longitudinal edges 15*a*, 15*b* of the fastener tapes 16*a*, 16*b* may increase the strength of the fastener chain when exposed to a bending force, which is perpendicular to both the fastener axis and the lateral axis (e.g. a force exerted in direction H). This may increase the ability of the coupled fastener stringers 12*a*, 12*b* to resist unwanted separation due to such a bending force.

The thickness F (shown in FIG. 9), in a direction parallel to the lateral axis T, of the coated material around the cord 15*a* of the first fastener stringer 12*a* is greater than a height HC, in a direction parallel to axis H, of the coated material around the cord 15*a*. The thickness F (shown in FIG. 9), in a direction parallel to the lateral axis T, of the cord 15*a* of the first fastener stringer 12*a* is greater than a depth G (shown in FIG. 7), in a direction parallel to the lateral axis T, of the groove 58 of the first coupling element 14*a*.

Referring now to FIGS. 4 and 10, the first coupling element 14*a* includes a first pressure portion 60 and the one of the adjacent coupling elements (e.g. the upper of the two coupling elements labelled 14*b* in FIG. 10) includes a corresponding second pressure portion 60*a*. In use, when the first row of coupling elements 14*a* is interdigitated with the second row of coupling elements 14*b*, the first pressure portion 60 contacts the second pressure portion 60*a* so as to create a seal therebetween.

Furthermore, the first coupling element 14*a* includes a third pressure portion 60*b* and the other of the adjacent coupling elements (e.g. the lower of the two coupling elements labelled 14*b* in FIG. 10) includes a corresponding fourth pressure portion 60*c*. In use, when the first row of coupling elements 14*a* is interdigitated with the second row of coupling elements 14*b*, the third pressure portion 60*b* contacts the fourth pressure portion 60*c* so as to create a seal therebetween.

In the embodiment shown in FIGS. 4 and 10, the first pressure portion 60, second pressure portion 60*a*, third pressure portion 60*b* and fourth pressure portion 60*c* each take the form of a protrusion (or fin) extending in a direction parallel to the fastener axis L from the head portion 54 and/or neck portion 56 of the coupling element 14*a*, 14*b* of which the relevant pressure portion forms part. In particular, it may be said that, in the embodiment shown, the protrusions extend from the underside (or main body facing portion) of the head portion of the coupling elements, that is, from a location on the head portion 54 which adjoins the neck portion 56. In other words, protrusions or pressure portions are formed alternatingly and repeatedly extending away from the base of groove 58 and distal ends of first and second longitudinal edges 15*a*, 15*b*.

The pressure portions help to increase the effectiveness of the seal between the coupling elements. This is achieved by the pressure portions being compressed in order for the coupling elements to interdigitate. The compression of the pressure portions means that, at the points where they contact other corresponding coupling elements, they exert a restoring force on the contacted coupling elements, resulting in an increase in the effectiveness of the seal.

Figure 13:
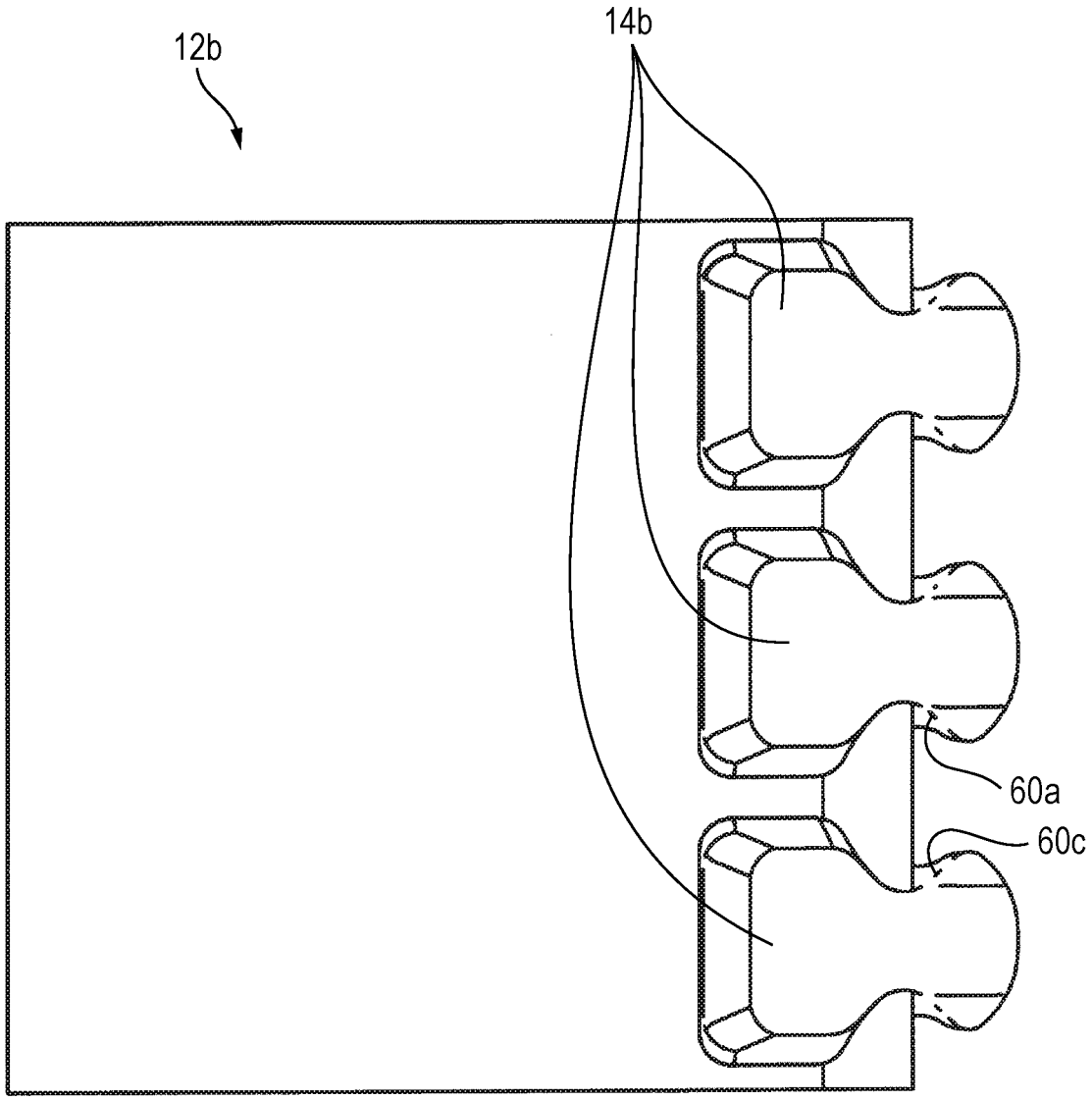
FIG. 13 is a plan view of a portion of a stringer of a fastener chain according to other embodiment of the invention.
Figure 14:
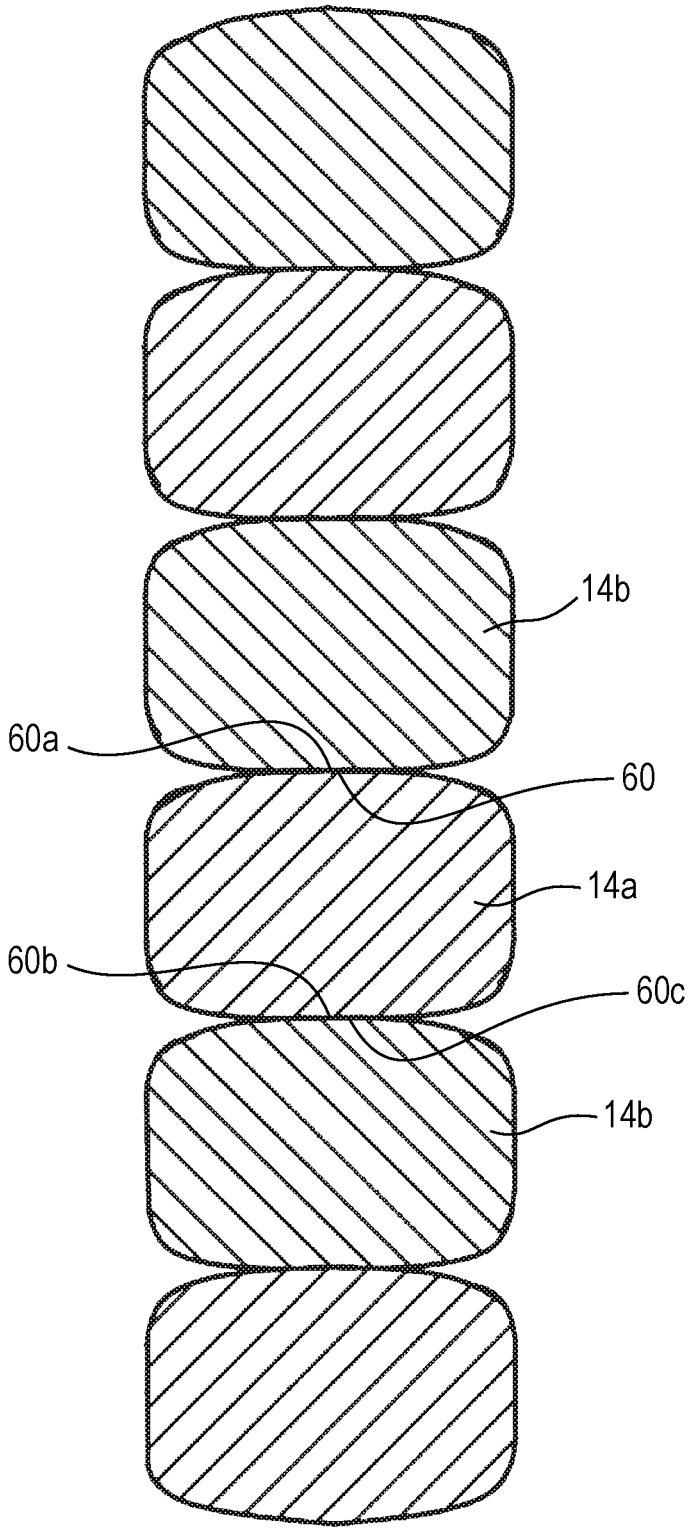
FIG. 14 is a front cross-sectional view of a portion of the fastener chain according to the same embodiment of the invention shown in FIG. 13.

In other embodiments, the pressure portions may take a different form. FIGS. 13 and 14 show an embodiment which is similar to that discussed above. FIGS. 13 and 14 are equivalent to FIGS. 5 and 10. FIG. 14 shows a front cross-sectional view in an equivalent plane and direction indicated by A in FIG. 8. In this embodiment, the coupling elements 14*a*, 14*b* include pressure portions 60, 60*a*, 60*b* and 60*c* which take the form of an enlarged underside of the head portion 54 of the coupling elements. This is represented by the dashed lines within FIG. 13. The enlarged undersides of the head portion of the relevant coupling elements means that, unlike most known coupling elements (which do not have enlarged undersides), when the coupling elements 14*a*, 14*b* are interdigitated, the pressure portions in the form of enlarged undersides are compressed, resulting in increased sealing effectiveness, as discussed above.

As a further benefit to that discussed above, given that the pressure portions compress when the coupling elements are interdigitated, if the chain is bent or otherwise deformed when the coupling elements are interdigitated, the pressure portions will be able to expand slightly to maintain contact between contacting coupling elements to thereby maintain the seal. If the pressure portions were not present, then it is possible that contact between otherwise contacting coupling elements would be broken, thereby breaking the seal.

The first coupling element 14*a* and adjacent coupling elements 14*b* (indeed, all the coupling elements 14*a* and coupling elements 14*b*) are formed from the same plastics material which is impermeable to water as the material which is used to coat and/or impregnate the fastener tapes. It has been found that forming the coupling elements from the same material that the fastener tapes are coated and/or impregnated with may increase the adhesion strength between the fastener tapes and their respective coupling elements.

The first coupling element 14*a* and adjacent coupling elements 14*b* (indeed, all the coupling elements 14*a* and coupling elements 14*b*) are formed from a material (such as polyurethane) whereby Young's Modulus for each of the coupling elements is between about 1000 and about 2000. This may help to improve the effectiveness of the seal between the coupling elements. This may be because, the more it is possible to compress the coupling elements, the more tolerant the fastener chain is to be bent whilst the relevant coupling elements and fastener tapes maintain contact. Furthermore as discussed above, in relation to the pressure portions, the more the coupling elements are compressed, the more they can exert a restoring force on each other, thereby increasing the sealing effectiveness of the chain.

As best seen in FIG. 6 and FIG. 11, the main body 50 of each of the first coupling elements 14*a* and adjacent coupling elements 14*b* has a tapered width parallel to the fastener axis L, whereby, at a first lateral location (indicated by the cross-section line B in FIG. 8), a first width FW, parallel to the fastener axis, of the main body 50 of the relevant coupling element, adjacent a first face 16*f* of the fastener tape 16*a*, 16*b* to which the coupling element 14*a*, 14*b* is mounted, is greater than, at the first lateral location, a second width SW, parallel to the fastener axis, of the main body of the relevant coupling element, at a location SL spaced from and above the first face 16*f* of the fastener tape to which the coupling element is mounted. The tapered sides are indicated by 62.

In the present example, the first width FW is a maximum width of the main body 50, above the first fastener tape 16*a*, at the first lateral location and the second width SW is a minimum width of the main body 50, above the first fastener tape 16*a*, at the first lateral location. However, in other embodiments, the first width and second width may be any appropriate widths.

In the present example, the second width is approximately 65% of the first width. However, in other embodiments, the second width may be between about 40% and about 85% of the first width. In the present example, the tapered sides 62 are inclined by an acute angle I of about 27 degrees relative to the axis H (i.e. the axis perpendicular to both the fastener axis L and lateral axis T). In other embodiments, the angle I may be any appropriate angle between about 15 degrees and about 45 degrees. It has been found that, if the angle I is too small, deformation of the coupling elements (as will be discussed in more detail below) occurs when the chain is bent, whereas if the angle I is too large, then the chain can burst when bent.

The tapering of sides of the main body of the coupling elements above the fastener tape has already been discussed. In addition, tapering of the sides of the main body below the fastener tape also occurs. In more detail, the main body 50 of each of the first coupling elements 14*a* and adjacent coupling elements 14*b* has a tapered width parallel to the fastener axis L, whereby, at a first lateral location (indicated by the cross-section line B in FIG. 8), a third width (which in this case is the same as the first width FW, but in other embodiments need not be so), parallel to the fastener axis, of the main body 50 of the relevant coupling element 14*a*, 14*b*, adjacent a second face 16*g* of the fastener tape 16*a*, 16*b* to which the coupling element 14*a*, 14*b* is mounted, is greater than, at the first lateral location, a fourth width (which in this case is the same as the second width SW, but in other embodiments need not be so), parallel to the fastener axis L, of the main body 50 of the relevant coupling element 14*a*, 14*b*, at a location spaced from and below the second face 16*g* of the fastener tape 16*a*, 16*b* to which the coupling element 14*a*, 14*b* is mounted. The tapered sides beneath the fastener tapes are indicated by 64.

In a similar manner to the tapered sides above the fastener tape, in the present embodiment, the third width FW is a maximum width of the main body 50, below the first fastener tape 16*a*, at the first lateral location and the fourth width SW is a minimum width of the main body 50, below the first fastener tape 16*a*, at the first lateral location. However, in other embodiments, the third width and fourth width may be any appropriate widths.

In the present example, the fourth width is approximately 65% of the third width. However, in other embodiments, the fourth width may be between about 40% and about 85% of the third width. In the present example, the tapered sides 64 are inclined by an acute angle I2 of about 27 degrees relative to the axis H (i.e. the axis perpendicular to both the fastener axis L and lateral axis T). In other embodiments, the angle I2 may be any appropriate angle between about 15 degrees and about 45 degrees. As before, it has been found that, if the angle I2 is too small, deformation of the coupling elements (as will be discussed in more detail below) occurs when the chain is bent, whereas if the angle I2 is too large, then the chain can burst when bent.

In the present example, the tapering of each of the tapered sides above the fastener tape is the same. Likewise, the tapering of each of the tapered sides below the fastener tape is the same. Furthermore, the tapering of the tapered sides above the fastener tape and below the fastener tape is the same. In other embodiments, one or more of these things may not be in the case.

The reason for the coupling elements 14*a*, 14*b* having tapered sides is as follows. As previously discussed, the coupling elements may be formed from a relatively compressible material. This helps, when the coupling elements are interdigitated, to improve the sealing between i) adjacent coupling elements, and ii) the coupling elements and the longitudinal edge (or cord) of the fastener tape that each coupling element contacts when the coupling elements interdigitate. However, forming the coupling elements from relatively compressible material means that the coupling elements may be compressed in situations which are undesirable.

One such situation is that shown in FIG. 11. The fastener chain has been bent about the lateral axis T of the slide fastener such that the slide fastener chain is no longer planar.

In this situation, the coupling element 14*a* contacts the coupling elements either side of it in its row of coupling elements of the first stringer. In particular, the main body 50 of the coupling element contacts the main bodies of each of the coupling elements either side of it at two locations beneath the fastener tape 16*a* indicated by P1 and P2 respectively. FIG. 11 shows the fastener chain bent to the extent that the coupling element 14*a* contacts the coupling elements either side of it. If the fastener chain is bent any further than shown in FIG. 11, then this will cause the coupling element 14*a* and those either side of it to be compressed. The compression of these coupling elements causes their shape to be deformed. Deformation of the coupling elements may mean that they are no longer able to maintain a watertight seal. Furthermore, deformation of the coupling elements may mean that they are no longer able to effectively interdigitate with the coupling elements of other stringer, thereby causing the slider chain to decouple or burst.

It will be understood that, because the sides 64 of the main body 50 of the coupling element 14*a* are tapered, the extent to which the fastener chain can be bent until the main body of the coupling element contacts the main bodies of the coupling elements either side of it, is greater than that in the absence of tapered sides. As such, the tapered sides of the coupling elements enable greater bending of the slide fastener chain to occur before any contact between the main bodies of adjacent coupling elements of the same stringer occurs, which may lead to deformation of the coupling elements. The tapering therefore reduces the fastener chain's risk of failure due to bending of the fastener chain.

It will be understood that, whilst the above discussion focusses on tapered sides 64 below the fastener tapes in conjunction with bending of the fastener chain which results in a portion of the lower face of the fastener tape being moved so that it faces another portion of the lower face of the fastener tape, the discussion is equally relevant to tapered sides 62 above the fastener tapes in conjunction with bending of the fastener chain which results in a portion of the upper face of the fastener tape being moved so that it faces another portion of the upper face of the fastener tape (i.e. a bend of the fastener chain in the opposite direction to that shown in FIG. 11).

The discussion above in relation to FIG. 11 focusses on the shaping of the elements so that compression of adjacent coupling elements during bending may not result degradation of the seal. However, it will be understood that in some embodiments, if the fastener chain is bent to the extent shown in the figure, the seal may be degraded by factors other than the aforementioned compression of adjacent coupling elements.

FIG. 12 shows a cross-sectional view of a slide fastener according to an embodiment of the present invention. The cross-section is taken in the plane and direction indicated by C in FIG. 3. The slider 11 is mounted on the interdigitated coupling elements 14*a*, 14*b* of the fastener chain.

The main body of each of the coupling elements 14*a*, 14*b* has a tapered rear. The rear of each coupling element 14*a*, 14*b* is the portion of the main body which is located furthest away from the head portion of the coupling element. The tapered rear consists of a first tapered side 66 located above the fastener tape 16*a*, 16*b*; and a second tapered side 68 located below the fastener tape 16*a*, 16*b*. Each of the tapered sides 66, 68 can be said to be tapered along the lateral axis T, such that the height (measured parallel to axis H) of the coupling element decreases as the lateral distance (measured parallel to axis T) from the head portion of the coupling element increases.

In the present embodiment, each of the tapered sides 66, 68 on each coupling element are the same. This need not be in the case of other embodiments, and the tapered sides on each coupling element may be different and/or the tapered side 66 above the fastener tape may be different from the tapered side 68 below the fastener tape.

In the present embodiment, the tapered sides 66, 68 are generally planar and are inclined such that the acute angle 69 between the tapered side 66, 68 and the axis H is approximately 50 degrees. In other embodiments, the acute angle may be between about 10 degrees and about 75 degrees.

The tapered sides 66 are provided between an upper surface of the main body of the relevant coupling element and a rear of the main body of the relevant coupling element. Tapered sides 68 are provided between a lower surface of the main body of the relevant coupling element and a rear of the main body of the relevant coupling element. The rear of the main body of the coupling elements runs generally parallel to the axis H.

The tapered sides 66, 68 mean that there is a gap between the upper and lower flanges 42, 44 of the slider respectively and the upper and rear sides of the coupling elements. This gap may help to reduce contact, and therefore friction, between the coupling elements 14*a*, 14*b* and the internal surfaces of the slider 11. This may be particularly important if the coupling elements are formed from a compressible material which is soft and therefore susceptible to wear due to friction. As such, the gaps defined by the tapered sides 66, 68 help to avoid wear and therefore possible degradation of the coupling elements due to use of the slider on the slide fastener.

In addition, because the gaps reduce the friction between the slider and the coupling elements, it will also make it easier for the slider to be moved along the fastener chain, and therefore easier to open and close the slide fastener.

The tapered sides 66, 68 do not run all the way from the upper surface and lower surface, respectively, of the main body of the coupling element to the fastener tape 16*a*, 16*b* on which the relevant coupling element is mounted. In fact, the tapered sides 66, 68 run from the upper surface and lower surface, respectively, of the main body, to a location which is spaced along the axis H from the upper surface and the lower surface, respectively, of the relevant fastener tape to which the coupling element is mounted.

It is also the case that the tapered sides 66 do not extend as close to the upper surface of the fastener tapes 16*a*, 16*b* as the upper flanges 42 of the slider 11. Likewise, the tapered sides 68 do not extend as close to the lower face of the fastener tapes 16*a*, 16*b* as the lower flanges 44 of the slider 11. In this manner, the separation distance H2 (measured parallel to axis H) between the upper and lower flanges 42, 44 of the slider is less than the separation distance H1 (measured parallel to axis H) between the portion of the tapered surface 66 closest to the upper surface of the fastener tape to which the coupling element is mounted, and the portion of the tapered surface 68 closest to the lower surface of the fastener tape to which the coupling element is mounted. In the present embodiment H1 is 1.5 mm and H2 is 1 mm. Of course, in other embodiments, these distances may be different.

It is thought that, by the tapered surfaces not extending as close to the fastener tape as the tips of the relevant upper or lower flanges of the slider, the tapered surfaces can still provide gaps between the coupling elements and the internal surfaces of the slider, thereby reducing wear, but also a rear side of the coupling element can still contact the upper and lower flanges of the slider to help guide the slider along the fastener chain.

Figure 15:
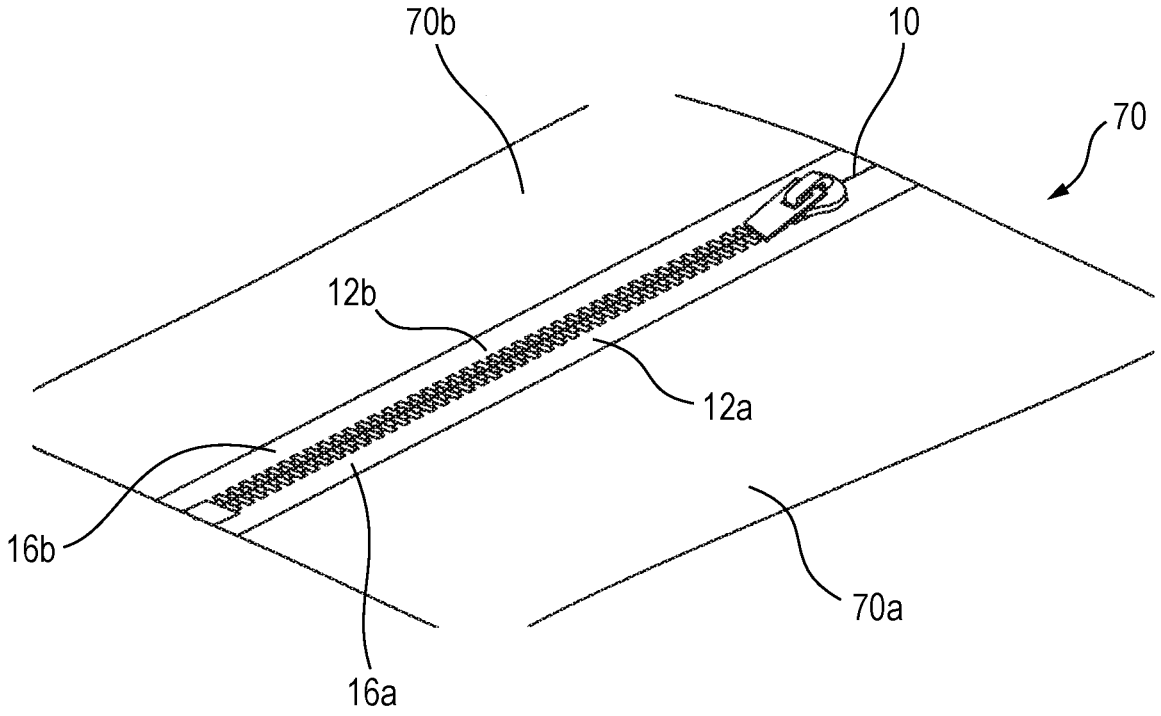
FIG. 15 is a perspective view of a portion of an article including a slide fastener according to the present invention.

FIG. 15 shows a schematic view of an article 70 including a slide fastener 10 according to the present invention. As is well known in the art, the slide fastener 10 is incorporated into the article 70 by the fastener tape 16*a* of the first stringer 12*a* being attached to a first portion 70*a* of the article in a watertight manner, and the fastener tape 16*b* of the second stringer 12*b* is attached to a second portion 70*b* of the article in a watertight manner. As such, when the slide fastener 10 is closed such that all of its coupling elements are interdigitated, the slide fastener joins the first and second portions of the article 70*a* and 70*b* in a watertight manner.

It should be understood that the examples provided herein are merely exemplary of the present disclosure and that various modifications may be made thereto without departing from the scope defined by the claims.

The invention claimed is:

1. A slide fastener chain comprising:

a first fastener stringer comprising a first fastener tape having a first row of coupling elements mounted on a first longitudinal edge of the first fastener tape; and a second fastener stringer comprising a second fastener tape having a second row of coupling elements mounted on a second longitudinal edge of the second fastener tape, wherein the first row of coupling elements is configured to be interdigitated with the second row of coupling elements along a fastener axis in order to secure the first fastener stringer and a second fastener stringer together, wherein each of the coupling elements of the first and second rows of coupling elements is shaped so as to comprise a main body having a shoulder portion, and a head portion extending parallel to a lateral axis, perpendicular the fastener axis, and away from the shoulder portion via a neck portion, the head portion defining a groove that extends parallel to the fastener axis, wherein the main body of each of the coupling elements of the first row of coupling elements is mounted to the first fastener tape, and the main body of each of the coupling elements of the second row of coupling elements is mounted to the second fastener tape, wherein, when the first row of coupling elements is interdigitated with the second row of coupling elements, the first longitudinal edge and second longitudinal edge remain spaced apart, and a first coupling element of the first row of coupling elements is received between two adjacent coupling elements of the second row of coupling elements such that:

i) the groove of the first coupling element receives and contacts, in a first contact region, a portion of the second longitudinal edge of the second fastener tape intermediate the adjacent coupling elements of the second row, ii) the head portion of the first coupling element is received between and contacts, at second and third contact regions respectively, the neck portions of the adjacent coupling elements of the second row, iii) one of the grooves of the adjacent coupling elements of the second row receives and contacts, in a fourth contact region, a first portion of the first longitudinal edge of the first fastener tape adjacent to the first coupling element, and iv) another of the grooves of the adjacent coupling elements of the second row receives and contacts, in a fifth contact region, a second portion of the first longitudinal edge of the first fastener tape adjacent to the first coupling element, wherein the first coupling element is intermediate the first and second portions of the first longitudinal edge of the first fastener tape, and wherein contact in each of the first, second, third, fourth and fifth contact regions forms a seal between the first coupling element and each of the adjacent coupling elements, the seal allying the first and second longitudinal edges.

2. The slide fastener chain according to claim 1, wherein the seal is a watertight seal such that water is substantially prevented from passing between the first coupling element and each of the adjacent coupling elements and between the first and second longitudinal edges.

3. The slide fastener chain according to claim 1, wherein a plurality of coupling elements of the first row of coupling elements are each received between two respective adjacent coupling elements of the second row of coupling elements such that:

i) the groove of each first coupling element of the first row receives and contacts, in a first contact region, a respective portion of the second longitudinal edge of the second fastener tape intermediate the respective adjacent coupling elements of the second row, ii) the head portion of each first coupling element of the first row is received between and contacts, at second and third contact regions respectively, the neck portions of the respective adjacent coupling elements of the second row, iii) one of the grooves of the respective adjacent coupling elements of the second row receives and contacts, in a fourth contact region, a respective first portion of the first longitudinal edge of the first fastener tape adjacent the to a respective first coupling element, and iv) another of the grooves of the respective adjacent coupling elements of the second row receives and contacts, in a fifth contact region, a respective second portion of the first longitudinal edge of the first fastener tape adjacent to a respective first coupling element, wherein each first coupling element is intermediate the respective first and second portions of the first longitudinal edge of the first fastener tape, and wherein the contact in each of the first, second, third, fourth and fifth contact regions forms a seal between each first coupling element and the respective adjacent coupling elements, the seal allying the first and second longitudinal edges, such that the seal is formed along an entire length of the fastener chain.

4. The slide fastener chain according to claim 1, wherein the first longitudinal edge of the first fastener tape and the second longitudinal edge of the second fastener tape each take a form of a cord.

5. The slide fastener chain according to claim 4, wherein each cord has a greater thickness in a direction perpendicular to both the fastener axis and the lateral axis than a thickness of a remainder of a respective fastener tape of the first fastener tape and the second fastener tape, which the cord forms part of the respective fastener tape.

6. The slide fastener chain according to claim 4, wherein the cord of each of the first and second fastener tapes is coated with and/or impregnated by a plastics material that is impermeable to water.

7. The slide fastener chain according to claim 1, wherein the first fastener tape and second fastener tape are coated with and/or impregnated by a plastics material that is impermeable to water.

8. The slide fastener chain according to claim 1, wherein the first row of coupling elements are mounted on the first longitudinal edge of the first fastener tape such that the first longitudinal edge meets the neck portion of each coupling element of the first row of coupling elements, and the second row of coupling elements are mounted on the second longitudinal edge of the second fastener tape such that the second longitudinal edge meets the neck portion of each coupling element of the second row of coupling elements.

9. The slide fastener chain according to claim 1, wherein each coupling element of the first and second rows of coupling elements comprises:

a first portion mounted to a first face of a respective fastener tape of the first fastener tape and the second fastener tape of a respective fastener stringer of the first fastener stringer and the second fastener stringer, which the first portion forms part of the respective fastener stringer, a second portion mounted to a second face, opposed to the first face, of the respective fastener tape of the respective fastener stringer, which the second portion forms part of the respective fastener stringer, and an intermediate portion joining both the first and second portions, the intermediate portion including at least the head portion of the coupling element.

10. The slide fastener chain according to claim 4, wherein a thickness of the cord of the first fastener stringer in a direction parallel to the lateral axis is greater than a separation distance in a direction parallel to the lateral axis between the cord of the first fastener stringer and the cord of the second fastener stringer, when the first row of coupling elements is interdigitated with the second row of coupling elements.

11. The slide fastener chain according to claim 4, wherein a thickness, in a direction parallel to the lateral axis, of the cord of the first fastener stringer is greater than a depth, in a direction parallel to the lateral axis, of the groove of the first coupling element.

12. The slide fastener chain according to claim 1, wherein the first coupling element includes a first pressure portion and one of the adjacent coupling elements includes a corresponding second pressure portion, and wherein, when the first row of coupling elements is interdigitated with the second row of coupling elements the first pressure portion contacts the second pressure portion such that the first and second pressure portions undergo compression so as to create a seal therebetween.

13. The slide fastener chain according to claim 12, wherein the first coupling element includes a third pressure portion and another of the adjacent coupling elements includes a corresponding fourth pressure portion, and wherein, when the first row of coupling elements is interdigitated with the second row of coupling elements, the third pressure portion contacts the fourth pressure portion such that the third and fourth pressure portions undergo compression so as to create a seal therebetween.

14. The slide fastener chain according to claim 13, wherein one or more of the first pressure portion, the second pressure portion the third pressure portion, and the fourth pressure portion take a form of a protrusion extending in a direction parallel to the fastener axis from the head portion and/or the neck portion of the coupling element, which the relevant pressure portion of the first pressure portion, the second pressure portion, the third pressure portion, and the fourth pressure portion forms part of the coupling element.

15. The slide fastener chain according to claim 13, wherein each of the seals between the first pressure portion and the second pressure portion and between the third pressure portion and the fourth pressure portion, is a watertight seal.

16. The slide fastener chain according to claim 1, wherein the main body of each of the first coupling element and the adjacent coupling elements has a tapered width parallel to the fastener axis, whereby, at a first lateral location, a first width parallel to the fastener axis, of the main body of the relevant coupling element, adjacent to a first face of the fastener tape to which the coupling element is mounted, is greater than, at the first lateral location, a second width, parallel to the fastener axis, of the main body of the relevant coupling element, at a location spaced from and above the first face of the fastener tape to which the coupling element is mounted.

17. The slide fastener chain according to claim 16, wherein the first width is a maximum width of the main body, above the fastener tape, at the first lateral location and the second width is a minimum width of the main body, above the fastener tape, at the first lateral location, and wherein the second width is between about 40% and about 85% of the first width.

18. The slide fastener chain according to claim 16, wherein the main body of each of the first coupling element and the adjacent coupling elements has a tapered width parallel to the fastener axis, whereby, at the first lateral location, a third width, parallel to the fastener axis, of the main body of the relevant coupling element, adjacent to a second face of the fastener tape to which the coupling element is mounted, is greater than, at the first lateral location, a fourth width, parallel to the fastener axis, of the main body of the relevant coupling element, at a location spaced from and below the second face of the fastener tape to which the coupling element is mounted.

19. The slide fastener chain according to claim 18, wherein the third width is a maximum width of the main body, below the fastener tape, at the first lateral location and the fourth width is a minimum width of the main body, below the fastener tape, at the first lateral location, and wherein the fourth width is between about 40% and about 85% of the third width.

20. The slide fastener chain according to claim 6, wherein the first coupling element and the adjacent coupling elements are formed from a plastics material that is impermeable to water.

21. The slide fastener chain according to claim 1, wherein each of the first coupling element and the adjacent coupling elements is formed from a material whereby Young's Modulus for each of the first coupling element and the adjacent coupling elements is between about 1000 and about 2000.

22. A slide fastener comprising:

the slide fastener chain according to claim 1; and a slider movably mounted on the first and second fastener stringers, such that the slider is movable relative to the first and second fastener stringers along the fastener axis:

in a first direction in order to interdigitate the first row of coupling elements of the first fastener stringer with the second row of coupling elements of the second fastener stringer in order to secure the first fastener stringer and the second fastener stringer together, and in a second direction in order to decouple the first row of coupling elements of the first fastener stringer from the second row of coupling elements of the second fastener stringer in order to decouple the first fastener stringer and the second fastener stringer.

23. The slide fastener according to claim 22, further comprising:

at least one top stop configured to provide a limit of movement of the slider along the fastener axis in the first direction; and/or a bottom stop configured to provide a limit of movement of the slider along the fastener axis in the second direction.

* * * * *